US011170701B2

(12) United States Patent
Qin et al.

(10) Patent No.: US 11,170,701 B2
(45) Date of Patent: Nov. 9, 2021

(54) DRIVING CIRCUIT, DRIVING METHOD THEREOF, DISPLAY PANEL AND DISPLAY DEVICE

(71) Applicant: BOE Technology Group Co., Ltd., Beijing (CN)

(72) Inventors: Wei Qin, Beijing (CN); Weixing Liu, Beijing (CN); Tieshi Wang, Beijing (CN); Kai Guo, Beijing (CN); Xiaolong Li, Beijing (CN); Kuanjun Peng, Beijing (CN); Zhiqiang Xu, Beijing (CN); Wanpeng Teng, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/970,818

(22) PCT Filed: Oct. 12, 2019

(86) PCT No.: PCT/CN2019/110866
§ 371 (c)(1),
(2) Date: Aug. 18, 2020

(87) PCT Pub. No.: WO2021/068254
PCT Pub. Date: Apr. 15, 2021

(65) Prior Publication Data

US 2021/0110759 A1 Apr. 15, 2021

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 3/2092* (2013.01); *G09G 2310/027* (2013.01); *G09G 2310/0278* (2013.01)

(58) Field of Classification Search
CPC ... G09G 2300/0426; G09G 2300/0857; G09G 2310/0243; G09G 2330/021;
(Continued)

(56) References Cited

U.S. PATENT DOCUMENTS

2002/0089496 A1* 7/2002 Numao ..... G09G 3/3648 345/204
2003/0011314 A1* 1/2003 Numao ..... G09G 3/3233 315/169.3
(Continued)

FOREIGN PATENT DOCUMENTS

CN 101261810 A 9/2008
CN 106991975 A 7/2017
(Continued)

*Primary Examiner* — Kenneth Bukowski
(74) *Attorney, Agent, or Firm* — Arent Fox LLP; Michael Fainberg

(57) ABSTRACT

An embodiment of the present disclosure provides a driving circuit, a driving method thereof, a display panel and a display device. The driving circuit includes a first transistor electrically connected between a signal input terminal and a light emitting device to be driven, a duration control circuit configured to provide a signal of a duration data signal terminal to a gate of the first transistor in response to a signal of a duration scanning signal terminal, and a latch circuit electrically connected with the gate of the first transistor and configured to latch the signal of the gate of the first transistor.

16 Claims, 11 Drawing Sheets

(58) Field of Classification Search
CPC ..... G09G 3/2014; G09G 3/2018; G09G 3/32; G09G 3/3225; G09G 3/3258
See application file for complete search history.

(56) References Cited

U.S. PATENT DOCUMENTS

| | | | | |
|---|---|---|---|---|
| 2007/0176950 | A1* | 8/2007 | Elliott | G02F 1/133514 345/694 |
| 2008/0186295 | A1 | 8/2008 | Choi | |
| 2015/0144893 | A1* | 5/2015 | Chen | H05B 45/60 257/40 |
| 2019/0096354 | A1 | 3/2019 | Chen et al. | |
| 2019/0147831 | A1* | 5/2019 | Lee | G09G 3/20 345/691 |
| 2019/0287455 | A1 | 9/2019 | Lu et al. | |

FOREIGN PATENT DOCUMENTS

| | | | |
|---|---|---|---|
| CN | 107403611 | A | 11/2017 |
| CN | 109872680 | A | 6/2019 |
| CN | 110021260 | A | 7/2019 |
| CN | 110459169 | A | 11/2019 |
| KR | 10-840074 | B1 | 6/2008 |

* cited by examiner

DRIVING CIRCUIT, DRIVING METHOD THEREOF, DISPLAY PANEL AND DISPLAY DEVICE

CROSS REFERENCE TO RELATED APPLICATIONS

This application is a National Stage of International Application No. PCT/CN2019/110866, filed on Oct. 12, 2019, which is hereby incorporated by reference in its entirety.

FIELD

The present disclosure relates to the field of display technology, in particular to a driving circuit, a driving method thereof, a display panel and a display device.

BACKGROUND

Electroluminescent diodes such as organic light emitting diodes (OLEDs), quantum dot light emitting diodes (QLEDs) and micro light emitting diodes (Micro LEDs) have the advantages of self-luminescence, low power consumption and the like, and are one of the hotspots in the application research field of the current electroluminescent display device. A general electroluminescent display device adopts a driving circuit to drive an electroluminescent diode to emit light.

SUMMARY

A driving circuit provided by an embodiment of the present disclosure includes:

a first transistor which is electrically connected between a signal input terminal and a light emitting device to be driven;

a duration control circuit which is configured to provide a signal of a duration data signal terminal to a gate of the first transistor in response to a signal of a duration scanning signal terminal; and a latch circuit which is electrically connected to the gate of the first transistor and configured to latch a signal of the gate of the first transistor.

Optionally, in the embodiment of the present disclosure, the driving circuit further includes a driving signal control circuit;

the signal input terminal is electrically connected with the first transistor through the driving signal control circuit; and the driving signal control circuit is configured to generate a driving signal for driving the light emitting device to be driven.

Optionally, in the embodiment of the present disclosure, the duration control circuit includes a second transistor; and a gate of the second transistor is electrically connected with the duration scanning signal terminal, a first terminal of the second transistor is electrically connected with a duration data signal terminal, and a second terminal of the second transistor is electrically connected with the gate of the first transistor.

Optionally, in the embodiment of the present disclosure, the latch circuit includes a third transistor, a fourth transistor, a fifth transistor and a sixth transistor;

a gate of the third transistor is electrically connected with the gate of the first transistor, a first terminal of the third transistor is electrically connected with a first reference signal terminal, and a second terminal of the third transistor is electrically connected with a gate of the fifth transistor and a gate of the sixth transistor;

a gate of the fourth transistor is electrically connected with the gate of the first transistor, a first terminal of the fourth transistor is electrically connected with a second reference signal terminal, and a second terminal of the fourth transistor is electrically connected with the gate of the fifth transistor and the gate of the sixth transistor;

a first terminal of the fifth transistor is electrically connected with the first reference signal terminal, and a second terminal of the fifth transistor is electrically connected with the gate of the first transistor; and a first terminal of the sixth transistor is electrically connected with the second reference signal terminal, and a second terminal of the sixth transistor is electrically connected with the gate of the first transistor.

The embodiment of the present disclosure further provides a display panel including: a plurality of pixel elements, wherein at least one of the plurality of pixel elements includes a plurality of sub-pixels; and each of the plurality of sub-pixels includes a light emitting device and a driving circuit; wherein the driving circuit is the driving circuit provided by the embodiment of the present disclosure.

Optionally, in the embodiment of the present disclosure, each of the plurality of pixel elements includes a plurality of sub-pixels arranged in an array manner, the plurality of sub-pixels include sub-pixels in at least two colors, and the number of the sub-pixels in each color is at least two.

Optionally, in the embodiment of the present disclosure, each of the pixel elements includes sub-pixels in a first color, sub-pixels in a second color and sub-pixels in a third color; and the sub-pixels in a same color are adjacent, and the sub-pixels in the first color, the sub-pixels in the second color and the sub-pixels in the third color are sequentially arranged in a first direction.

Optionally, in the embodiment of the present disclosure, each of the pixel element includes sub-pixels in a first color, sub-pixels in a second color and sub-pixels in a third color; and in the first direction, sub-pixels in other colors are arranged among the sub-pixels in a same color.

Optionally, in the embodiment of the present disclosure, a number of the sub-pixels in each color is at least four; and in the same pixel element, the sub-pixels in the first color, the sub-pixels in the second color and the sub-pixels in the third color are arranged in a two-row six-column structure;

in a first row of the two-row six-column structure, each of the sub-pixels in the first color, each of the sub-pixels in the second color and each of the sub-pixels in the third color are sequentially arranged; and in a second row of the two-row six-column structure, each of the sub-pixels in the third color, each of the sub-pixels in the first color and each of the sub-pixels in the second color are sequentially arranged.

Optionally, in the embodiment of the present disclosure, the display panel further includes a plurality of duration data lines; and duration data signal terminals of driving circuits of the sub-pixels in a same column are electrically connected with a same duration data line.

Optionally, in the embodiment of the present disclosure, the display panel further includes a plurality of first duration data input lines, a plurality of first phase detectors and a plurality of first charge pump circuits; wherein one duration data line corresponds to one first phase detector, one first charge pump circuit and one first duration data input line; and the respective one first duration data input line is electrically connected with the respective one duration data line through the corresponding first phase detectors and the corresponding first charge pump circuits successively.

Optionally, in the embodiment of the present disclosure, the display panel further includes a plurality of second duration data input lines, a plurality of second phase detectors and a plurality of second charge pump circuits; wherein one second duration data input line is electrically connected with one duration data line;

one sub-pixel includes one second phase detector and one second charge pump circuit; and for each of the sub-pixels, the duration data line is electrically connected with the duration data signal terminal of the driving circuit through the corresponding second phase detector and the corresponding second charge pump circuit successively.

The embodiment of the present disclosure further provides a display device including the display panel.

The embodiment of the present disclosure further provides a driving method of the driving circuit, including:

driving the driving circuit to operate in at least one light emitting adjustment period in one frame of display time; wherein the light emitting adjustment period includes a duration data writing stage and a light emitting adjustment stage;

in the duration data writing stage, the duration control circuit provides a signal of a duration data signal terminal to a gate of the first transistor to turn on or off the first transistor in response to a signal of a duration scanning signal terminal; and the latch circuit latches a signal of the gate of the first transistor; and in the light emitting adjustment stage, the latch circuit latches the signal of the gate of the first transistor so that the first transistor maintains the state of the duration data writing stage.

Optionally, in the embodiment of the present disclosure, the driving signal control circuit includes a reset signal terminal, a display scanning signal terminal, a light emitting control signal terminal and a display data signal terminal; and a reset stage and a compensation stage are in the one frame of display time and before the light emitting adjustment period; wherein the method further includes:

in the reset stage, the driving signal control circuit resets in response to a signal of the reset signal terminal;

in the compensation stage, the driving signal control circuit carries out threshold compensation according to a signal of the display scanning signal terminal and a signal of the display data signal terminal; and in the light emitting adjustment stage, the method further includes: in a preset duration, the driving signal control circuit communicates the signal input terminal with the first transistor in response to a signal of the light emitting control signal terminal; and when the first transistor is turned on, a driving signal for driving the light emitting device is generated to drive the light emitting device to emit light; wherein the preset duration is not greater than a duration of the light emitting adjustment stage.

DETAILED DESCRIPTION OF THE EMBODIMENTS

Figure 1:
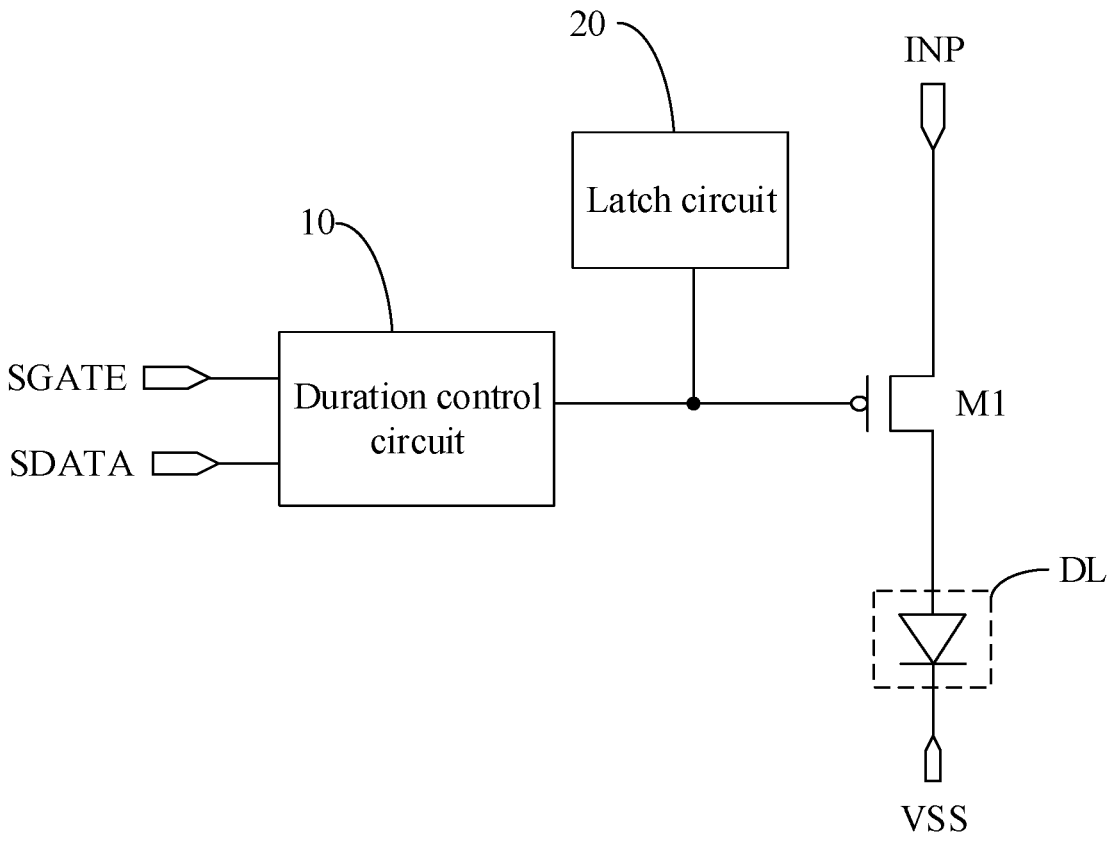
FIG. 1 is a schematic diagram of structures of some driving circuits according to an embodiment of the present disclosure.

To make the objects, technical solutions and advantages of the embodiments of the present disclosure more apparent, the technical solutions of the embodiments of the present disclosure will be clearly and completely described below with reference to the drawings of the embodiments of the present disclosure. It is to be understood that the described embodiments are only a few embodiments of the present disclosure, and not all embodiments. And the embodiments and features of the embodiments in the present disclosure may be combined with each other without conflict. All other embodiments, which may be derived by a person skilled in the art from the described embodiments of the present disclosure without inventive step, are within the scope of protection of the present disclosure.

Unless defined otherwise, technical terms or scientific terms used herein shall have the ordinary meaning as understood by one of ordinary skilled in the art to which the present disclosure belongs. The use of 'first', 'second' and the like in the present disclosure is not intended to indicate any order, quantity, or importance, but rather is used to distinguish one element from another. The word 'comprising' or 'comprises' and the like, means that the element or item preceding the word comprises the element or item listed after the word and its equivalent, but does not exclude other elements or items. The terms 'connected' or 'coupled' and the like are not restricted to physical or mechanical connections, but may include electrical connections, whether direct or indirect.

It should be noted that the sizes and shapes of the various figures in the drawings are not to scale, but are merely intended to schematically illustrate the present disclosure.

And like or similar reference numerals refer to like or similar elements or elements having like or similar functions throughout.

An embodiment of the present disclosure provides a driving circuit, as shown in FIG. 1, the driving circuit may include:

a first transistor M1, electrically connected between a signal input terminal INP and a light emitting device DL to be driven;

a duration control circuit 10, configured to provide a signal of a duration data signal terminal SDATA to a gate of the first transistor M1 in response to a signal of a duration scanning signal terminal SGATE; and a latch circuit 20, electrically connected with the gate of the first transistor M1, and configured to latch a signal of the gate of the first transistor M1.

The driving circuit provided by the embodiment of the present disclosure is provided with the duration control circuit 10. Under the control of the signal of the duration scanning signal terminal SGATE, the duration control circuit 10 provides the signal of the duration data signal terminal SDATA to the gate of the first transistor M1 to control turned-on duration of the first transistor M1, and thus, light emitting duration of the light emitting device DL to be driven may be controlled. Moreover, by this way, the turned-on duration of the first transistor M1 may be controlled independently, so that the light emitting duration of a driving signal of the light emitting device DL to be driven may be adjusted independently. The signal of the gate of the first transistor M1 may be latched by the latch circuit 20. Because the signal of the gate of the first transistor M1 may be latched through the latch circuit, so that stability of the signal of the gate of the first transistor M1 may be maintained for a long time, and the driving circuit provided by the embodiment of the present disclosure may be applied to a display panel in low-frequency refresh to guarantee the display effect of the display panel. Moreover, compared with a capacitor, the latch circuit 20 has the characteristic that the charging time of the signal may be shortened, so that the driving circuit provided by the embodiment of the present disclosure may be applied to a display panel in high-frequency refresh to guarantee the display effect of the display panel.

In specific implementation, the light emitting device DL to be driven refers to that the driving circuit is not provided with a light emitting device DL, after the driving circuit is applied to a display panel, the light emitting device DL in the display panel may be electrically connected with the driving circuit to drive the light emitting device DL in the display panel through the driving circuit. When the first transistor M1 is turned on, a driving signal of the signal input terminal INP may be provided for the light emitting device DL to drive the light emitting device DL to emit light. Through control over the turned-on duration of the first transistor M1, duration of the driving signal input to the light emitting device DL is controlled so as to control the light emitting duration of the light emitting device DL. Therefore, the light emitting duration of the light emitting device DL in one frame of time may be controlled. Because different light emitting durations may correspond to different gray scales, displaying of more gray scales may be realized by controlling the light emitting durations, and the displaying effect is improved. The driving signal may serve as driving current or driving voltage for driving the light emitting device DL to emit light.

In specific implementation, in the embodiment of the present disclosure, a first terminal of the light emitting device DL is electrically connected with a second terminal of the first transistor M1, and a second terminal of the light emitting device DL is electrically connected with a second power supply terminal VSS. The first terminal of the light emitting device DL is a positive electrode thereof while the second terminal of the light emitting device DL is a negative electrode thereof. Moreover, the light emitting device DL is generally an electroluminescent diode, for example, the light emitting device DL may include at least one of a micro light emitting diode (Micro LED), an organic light emitting diode (OLED) or a quantum dot light emitting diode (QLED). In addition, generally, the light emitting device DL has a light emitting threshold voltage, and the light emitting device DL emits light when voltage at two terminals of the light emitting device DL is greater than or equal to the light emitting threshold voltage. In actual application, the specific structure of the light emitting device DL may be designed and determined according to an actual application environment, and it is not limited herein.

Figure 2:
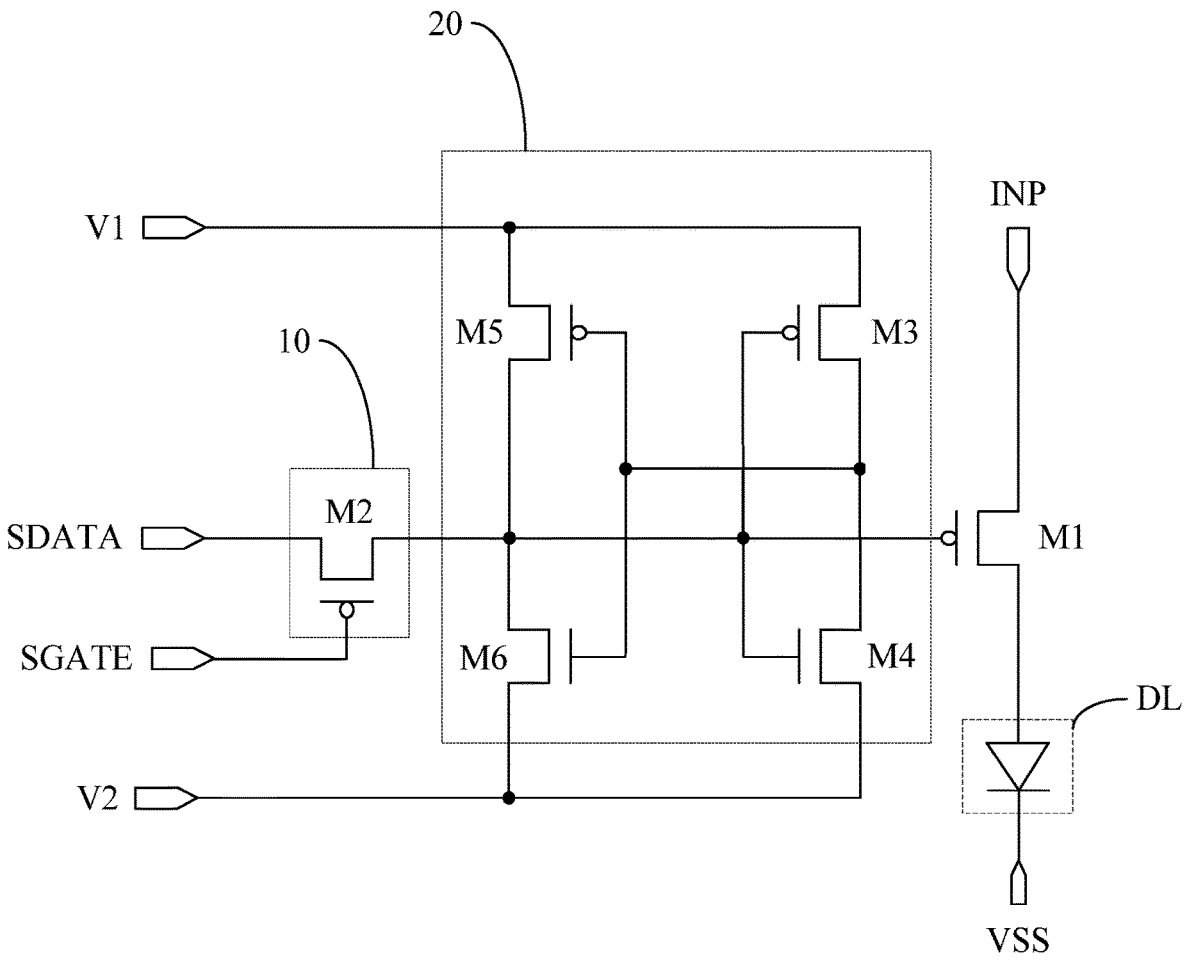
FIG. 2 is a schematic diagram of specific structures of some driving circuits according to an embodiment of the present disclosure.

In specific implementation, in an embodiment of the present disclosure, as shown in FIG. 2, the duration control circuit 10 includes a second transistor M2; wherein a gate of the second transistor M2 is electrically connected with the duration scanning signal terminal SGATE, a first terminal of the second transistor M2 is electrically connected with the duration data signal terminal SDATA, and a second terminal of the second transistor M2 is electrically connected with the gate of the first transistor M1. Exemplarily, when the second transistor M2 is turned on under the control of the duration scanning signal terminal SGATE, the signal of the duration data signal terminal SDATA may be provided for the gate of the first transistor M1.

In specific implementation, in the embodiment of the present disclosure, as shown in FIG. 2, the second transistor M2 may be a P-type transistor. Alternatively, the second transistor M2 may be an N-type transistor. Of course, in actual application, the second transistor M2 may be designed and determined according to an actual application environment, and it is not limited herein.

In specific implementation, in the embodiment of the present disclosure, as shown in FIG. 2, the latch circuit 20 may include a third transistor M3, a fourth transistor M4, a fifth transistor M5 and a sixth transistor M6;

a gate of the third transistor M3 is electrically connected with the gate of the first transistor M1, a first terminal of the third transistor M3 is electrically connected with a first reference signal terminal V1, and a second terminal of the third transistor M3 is electrically connected with a gate of the fifth transistor M5 and a gate of the sixth transistor M6;

a gate of the fourth transistor M4 is electrically connected with the gate of the first transistor M1, a first terminal of the fourth transistor M4 is electrically connected with a second reference signal terminal V2, and a second terminal of the fourth transistor M4 is electrically connected with the gate of the fifth transistor M5 and the gate of the sixth transistor M6;

a first terminal of the fifth transistor M5 is electrically connected with the first reference signal terminal V1, and a second terminal of the fifth transistor M5 is electrically connected with the gate of the first transistor M1; and a first terminal of the sixth transistor M6 is electrically connected with the second reference signal terminal V2, and a second terminal of the sixth transistor M6 is electrically connected with the gate of the first transistor M1.

In specific implementation, in an embodiment of the present disclosure, when the third transistor M3 is turned on under the control of the signal of the gate of the first transistor M1, the signal of the first reference signal terminal V1 may be provided for the gate of the fifth transistor M5 and the gate of the sixth transistor M6. When the fourth transistor M4 is turned on under the control of the signal of the gate of the first transistor M1, the signal of the second reference signal terminal V2 may be provided for the gate of the fifth transistor M5 and the gate of the sixth transistor M6. When the fifth transistor M5 is turned on under the control of the signal of the gate of the fifth transistor M5, the signal of the first reference signal terminal V1 may be provided for the gate of the first transistor M1. When the sixth transistor M6 is turned on under the control of the signal of the gate of the sixth transistor M6, the signal of the second reference signal terminal V2 may be provided for the gate of the first transistor M1 for electric connection. Thus, the signal of the gate of the first transistor M1 may be latched.

In specific implementation, in the embodiment of the present disclosure, as shown in FIG. 2, the third transistor M3 and the fifth transistor M5 may be P-type transistors, and the fourth transistor M4 and the sixth transistor M6 may be N-type transistors. Alternatively, the third transistor M3 and the fifth transistor M5 may be N-type transistors, and the fourth transistor M4 and the sixth transistor M6 may be P-type transistors. Of course, in actual application, they may be designed and determined according to an actual application environment, and it is not limited herein.

The above is only an example of specific structures of various circuits in the driving circuit provided in the embodiment of the present disclosure, and in specific implementation, the specific structures of the circuits are not limited to the structures provided in the embodiment of the present disclosure, and may be other structures known to those skilled in the art, which are within the scope of protection of the present disclosure, and it is not specifically limited herein.

In specific implementation, in an embodiment of the present disclosure, a voltage Vdd of the signal input terminal INP is generally a positive value, and a voltage Vss of a second power supply terminal is generally a negative value or the second power supply terminal is generally grounded. In actual application, specific numerical values of the voltage Vdd of the signal input terminal INP and the voltage Vss of the second power supply terminal may be designed and determined according to an actual application environment, and it is not limited herein.

Further, in specific implementation, in an embodiment of the present disclosure, a P-type transistor is turned off under the action of a high-level signal, and is turned on under the action of a low-level signal. An N-type transistor is turned on under the action of a high-level signal, and is turned off under the action of a low-level signal.

It should be noted that the transistors mentioned in the foregoing embodiments of the present disclosure may be thin film transistors (TFTs) or metal oxide semiconductors (MOSs), and it is not limited herein.

In specific implementation, a first terminal of the transistor may be used as a source while a second terminal of the transistor may be used as a drain according to the type of the transistor and a signal of a gate of the transistor; or, conversely, a first terminal of the transistor is used as a drain of the transistor while a second terminal of the transistor is used as a source of the transistor, which may be designed and determined according to an actual application environment, and specific distinguishing is not made herein.

Figure 3:
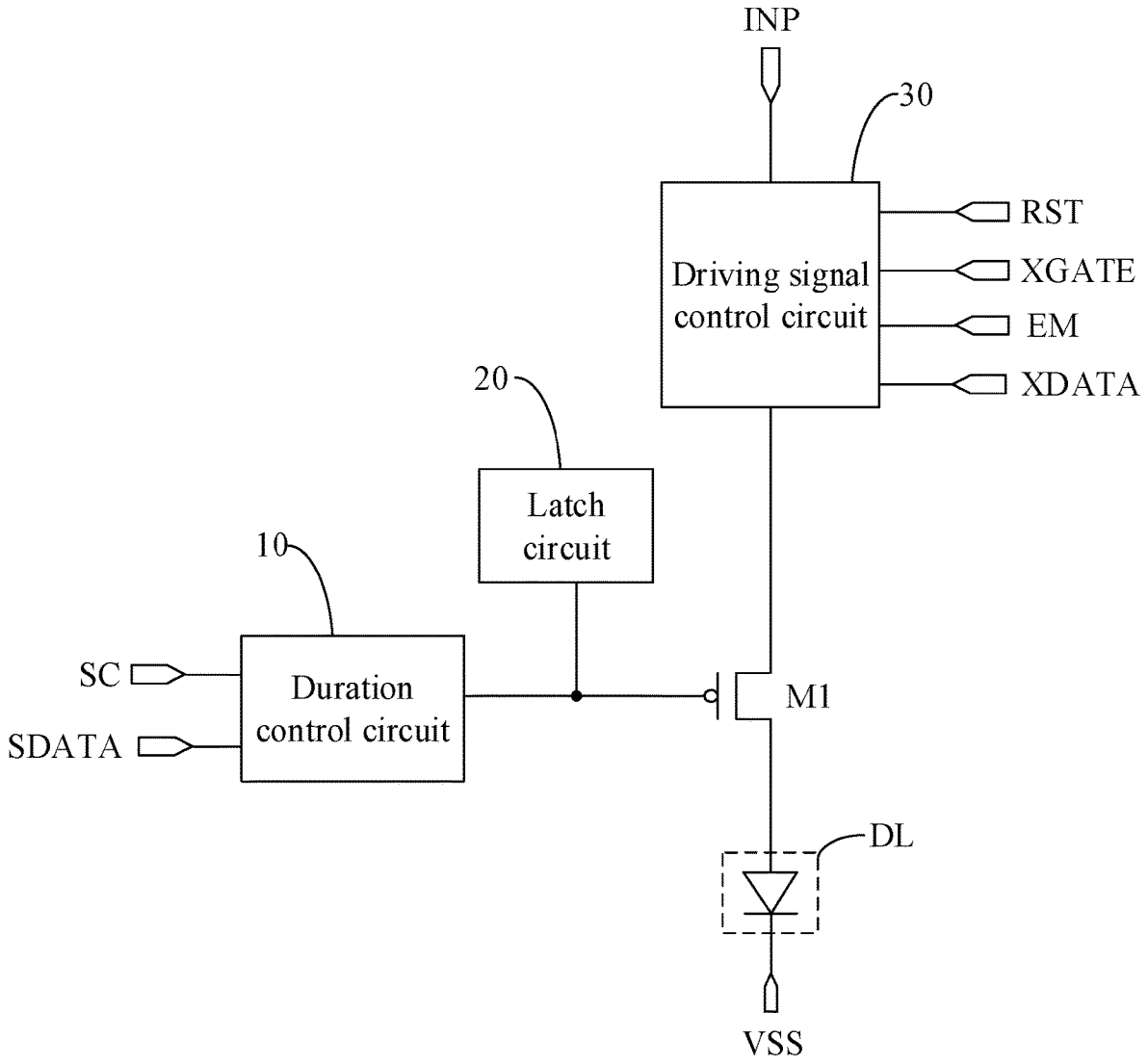
FIG. 3 is a schematic diagram of structures of some other driving circuits according to an embodiment of the present disclosure.

An embodiment of the present disclosure also provides another driving circuit, as shown in FIG. 3. It is modified from implementation modes in the foregoing embodiments. Hereinafter, only differences between the present embodiment and the foregoing embodiment will be described, and the similarities will not be described in detail herein.

In specific implementation, in an embodiment of the present disclosure, as shown in FIG. 3, the driving circuit further may include a driving signal control circuit 30; wherein the signal input terminal INP is electrically connected with the first transistor M1 through the driving signal control circuit 30; and the driving signal control circuit 30 is configured to generate a driving signal for driving the light emitting device DL to be driven.

In specific implementation, in the embodiment of the present disclosure, as shown in FIG. 3, the driving signal control circuit 30 may include a reset signal terminal RST, a display scanning signal terminal XGATE, a light emitting control signal terminal EM and a display data signal terminal XDATA; wherein the driving signal control circuit 30 resets in response to a signal of the reset signal terminal RST, and carries out threshold compensation according to the signal of the display scanning signal terminal XGATE and the signal of the display data signal terminal XDATA, and in a preset duration, the driving signal control circuit 30 communicates the signal input terminal INP to the first transistor M1 in response to the signal of the light emitting control signal terminal EM; when the first transistor M1 is turned on, a driving signal for driving the light emitting device DL is generated to drive the light emitting device DL to emit light; and the preset duration is not greater than the duration of the light emitting adjustment stage.

In specific implementation, in the embodiment of the present disclosure, the driving signal control circuit 30 may include a pixel compensation circuit. Exemplarily, in combination with FIG. 4, the pixel compensation circuit 31 may include a first switch transistor M01, a second switch transistor M02, a third switch transistor M03, a fourth switch transistor M04, a fifth switch transistor M05, a driving transistor M0 and a storage capacitor C0.

A gate of the first switch transistor M01 is electrically connected with the reset signal terminal RST, a first terminal of the first switch transistor M01 is electrically connected with an initialization signal terminal VINIT, and a second terminal of the first switch transistor M01 is electrically connected with a gate of the driving transistor M0.

A gate of the second switch transistor M02 is electrically connected with the display scanning signal terminal XGATE, a first terminal of the second switch transistor M02 is electrically connected with the display data signal terminal XDATA, and a second terminal of the second switch transistor M02 is electrically connected with a first terminal of the driving transistor M0.

A gate of the third switch transistor M03 is electrically connected with the display scanning signal terminal XGATE, a first terminal of the third switch transistor M03 is electrically connected with the gate of the driving transistor M0, and a second terminal of the third switch transistor M03 is electrically connected with a second terminal of the driving transistor M0.

A gate of the fourth switch transistor M04 is electrically connected with the light emitting control signal terminal EM, a first terminal of the fourth switch transistor M04 is electrically connected with the second terminal of the driving transistor M0, and a second terminal of the fourth switch transistor M04 is electrically connected with the first terminal of the first transistor M1.

A gate of the fifth switch transistor M05 is electrically connected with the light emitting control signal terminal EM, a first terminal of the fifth switch transistor M05 is electrically connected with the signal input terminal INP, and a second terminal of the fifth switch transistor M05 is electrically connected with the first terminal of the driving transistor M0.

A first terminal of the storage capacitor C0 is electrically connected with the signal input terminal INP, and a second terminal of the storage capacitor C0 is electrically connected with the gate of the driving transistor M0.

The operating process of the pixel compensation circuit may be basically the same as the operating process in the related art and is not repeated herein. Of course, in actual application, the pixel compensation circuit may also adopt other structures capable of compensating the threshold voltage of the driving transistor M0, and it is not limited herein.

Figure 5:
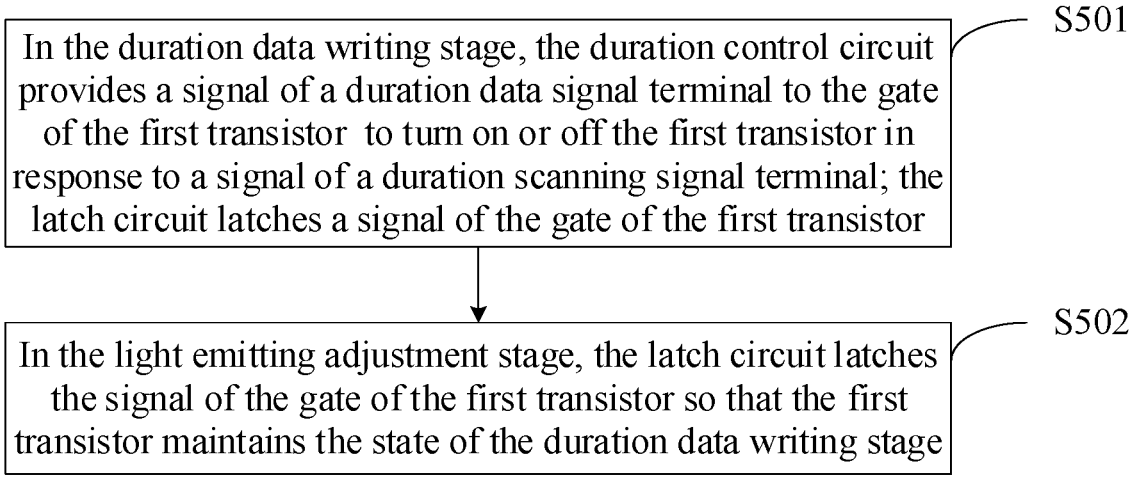
FIG. 5 is a flow chart of a driving method according to an embodiment of the present disclosure.

The embodiment of the present disclosure further provides a driving method of the driving circuit, and the driving method includes: in one frame of display time, the driving circuit is driven to operate in at least one light emitting adjustment period; as shown in FIG. 5, each light emitting adjustment period includes a duration data writing stage and a light emitting adjustment stage.

S501, in the duration data writing stage, the duration control circuit provides the signal of the duration data signal terminal to the gate of the first transistor in response to the signal of the duration scanning signal terminal to control the first transistor to be turned on or turned off; and the latch circuit latches the signal of the gate of the first transistor.

S502, in the light emitting adjustment stage, the latch circuit latches the signal of the gate of the first transistor, so that the first transistor maintains the state in the duration data writing stage.

Figure 6A:
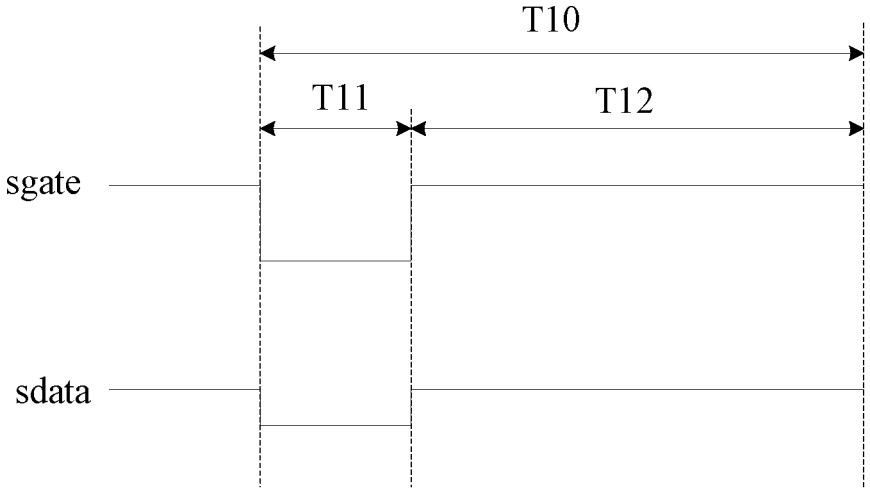
FIG. 6A is a timing diagram of some circuits according to an embodiment of the present disclosure.
Figure 6B:
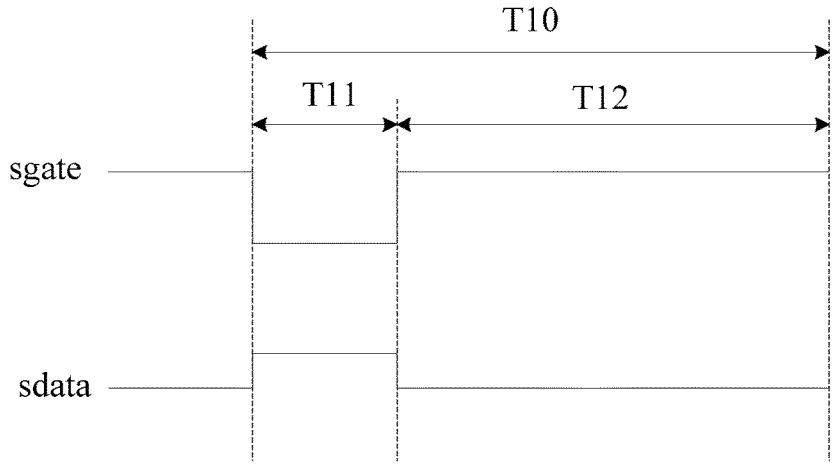
FIG. 6B is a timing diagram of some other circuits according to an embodiment of the present disclosure.

In specific implementation, in the embodiment of the present disclosure, as shown in FIG. 6A and FIG. 6B, in one frame of display time, the driving circuit may be driven to operate in one light emitting adjustment period T10, that is, one frame of display time has one light emitting adjustment period. With the structure of the driving circuit shown in FIG. 2 as an example, the operating process of the driving circuit provided by the embodiment of the present disclosure is described in combination with circuit timing diagrams shown in FIG. 6A and 6B. Wherein, sgate represents a signal of the duration scanning signal terminal SGATE, and sdata represents a signal of the duration data signal terminal SDATA.

The duration data writing stage T11 and the light emitting adjustment stage T12 in the circuit timing diagrams shown in FIG. 6A and FIG. 6B are mainly selected. It should be explained that the signal of the first reference signal terminal V1 is a high-level signal, and the signal of the second reference signal terminal V2 is a low-level signal. Exemplarily, the voltage of the signal of the first reference signal terminal V1 is the same as the voltage of the high-level signal of the duration data signal terminal SDATA, and the voltage of the signal of the second reference signal terminal V2 is the same as the voltage of the low-level signal of the duration data signal terminal SDATA.

In combination with FIG. 6A, in the duration data writing stage T11, a signal sgate of the duration scanning signal terminal SGATE is a low-level signal, and the second transistor M2 is turned on, so that the low-level signal sdata of the duration data signal terminal SDATA is provided for the gate of the first transistor M1, the level of the gate of the first transistor M1 is low, the first transistor M1 and the third transistor M3 are turned on, and the fourth transistor M4 is turned off. The first transistor M1 which is turned on provides a driving current of the signal input terminal INP to the light emitting device DL so as to drive the light emitting device DL to emit light. The third transistor M3 which is turned on provides the high-level signal of the first reference signal terminal V1 to the gate of the fifth transistor M5 and the gate of the sixth transistor M6 so as to turn off the fifth transistor M5 and turn on the sixth transistor M6. The sixth transistor M6 which is turned on provides the low-level signal of the second reference signal terminal V2 to the gate of the first transistor M1, so that the level of the gate of the first transistor M1 is further low, and the level of the gate of the first transistor M1 is latched.

In the light emitting adjustment stage T12, the signal sgate of the duration scanning signal terminal SGATE is a high-level signal, and the second transistor M2 is turned off. Due to the effects of the third transistor M3, the fourth transistor M4, the fifth transistor M5 and the sixth transistor M6, the level of the gate of the first transistor M1 is latched into a low level, and thus, the first transistor M1 is turned on. The first transistor M1 which is turned on provides the driving current of the signal input terminal INP to the light emitting device DL so as to drive the light emitting device DL to emit light. Specifically, the level of the gate of the first transistor M1 is low, so that the third transistor M3 is turned on, and the fourth transistor M4 is turned off. The third transistor M3 which is turned on provides the high-level signal of the first reference signal terminal V1 to the gate of the fifth transistor M5 and the gate of the sixth transistor M6 so as to turn off the fifth transistor M5 and turn on the sixth transistor M6. The sixth transistor M6 which is on provides the low-level signal of the second reference signal terminal V2 to the gate of the first transistor M1, so that the level of the gate of the first transistor M1 is further low, and the level of the gate of the first transistor M1 is latched.

In combination with FIG. 6B, in the duration data writing stage T11, the signal sgate of the duration scanning signal terminal SGATE is a low-level signal, and the second transistor M2 is turned on to provide the high-level signal sdata of the duration data signal terminal SDATA to the gate of the first transistor M1, so that the level of the gate of the first transistor M1 is high so as to turn off the first transistor M1 and the third transistor M3 and turn on the fourth transistor M4. The first transistor M1 which is turned off disconnects the signal input terminal INP from the light emitting device DL, and the light emitting device DL stops emitting light. The fourth transistor M4 which is turned on provides the low-level signal of the second reference signal terminal V2 to the gate of the fifth transistor M5 and the gate of the sixth transistor M6 so as to turn on the fifth transistor M5 and turn off the sixth transistor M6. The fifth transistor M5 which is turned on provides the high-level signal of the first reference signal terminal V1 to the gate of the first transistor M1, so that the level of the gate of the first transistor M1 is further high, and the level of the gate of the first transistor M1 is latched.

In the light emitting adjustment stage T12, the signal sgate of the duration scanning signal terminal SGATE is a high-level signal, and the second transistor M2 is turned off. Due to the effects of the third transistor M3, the fourth transistor M4, the fifth transistor M5 and the sixth transistor M6, the level of the gate of the first transistor M1 may be latched to a high level, so that the first transistor M1 is turned off, and the light emitting device DL does not emit light. Specifically, the fourth transistor M4 which is turned on provides the low-level signal of the second reference signal terminal V2 to the gate of the fifth transistor M5 and the gate of the sixth transistor M6 so as to turn on the fifth transistor M5 and turn off the sixth transistor M6. The fifth transistor M5 which is turned on provides the high-level signal of the first reference signal terminal V1 to the gate of the first transistor M1, so that the level of the gate of the first transistor M1 is further high, and the level of the gate of the first transistor M1 is latched.

In conclusion, the first transistor M1 may be controlled to be turned on in one frame of display time, so that the light emitting device DL emits light in the frame of display time. Or the first transistor M1 may be controlled to be turned off in one frame of display time, so that the light emitting device DL does not emit light in the frame of display time.

In specific implementation, in the embodiment of the present disclosure, the driving circuit may be driven to operate in at least two light emitting adjustment periods in one frame of display time F. The first transistor M1 may be turned on in two adjacent light emitting adjustment periods. Alternatively, the first transistors M1 may be turned off in two adjacent light emitting adjustment periods. Alternatively, in two adjacent light emitting adjustment periods, the first transistor M1 may be turned on in the previous light emitting adjustment period, and the first transistor M1 may be turned off in the subsequent light emitting adjustment period; and alternatively, the first transistor M1 may be turned off in the previous light emitting adjustment period, and the first transistor M1 may be turned on in the subsequent light emitting adjustment period, it is not limited herein.

Figure 7:
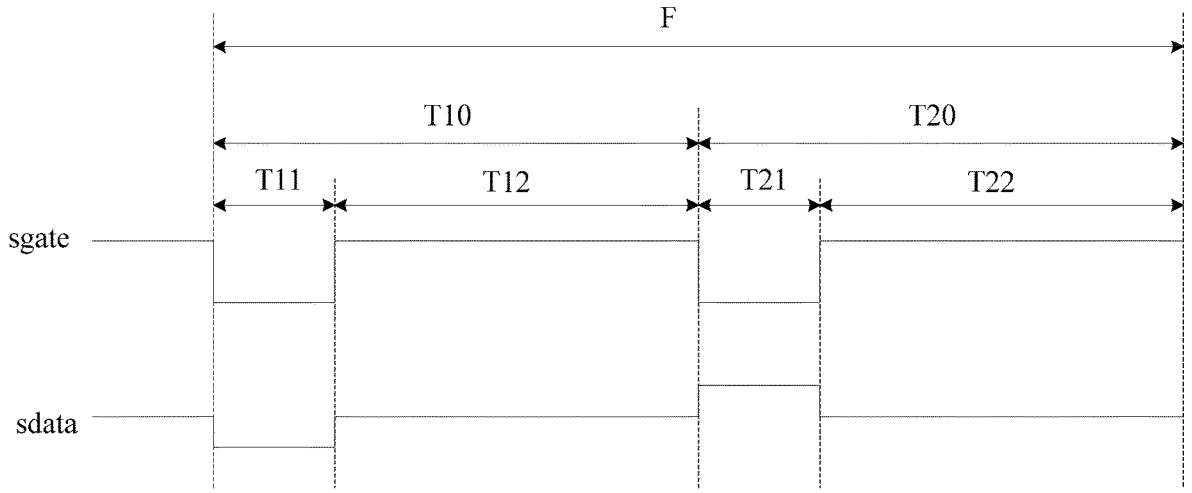
FIG. 7 is a timing diagram of some other circuits according to an embodiment of the present disclosure.

In specific implementation, in the embodiment of the present disclosure, as shown in FIG. 7, the driving circuit may be driven to operate in the light emitting adjustment period T10 and the light emitting adjustment period T20 in one frame of display time F. Of course, the driving circuit may also be driven to operate in three light emitting adjustment periods in one frame of display time, and the driving circuit may also be driven to operate in four, five or more light emitting adjustment periods in one frame of display time. Of course, in actual application, it may be designed and determined according to an actual application environment, and it is not limited herein.

The following describes an operating process of the driving circuit provided in the embodiment of the present disclosure with reference to a circuit timing diagram shown in FIG. 7 by taking the structure of the driving circuit shown in FIG. 2 as an example. Sgate represents the signal of the duration scanning signal terminal SGATE, and sdate represents the signal of the duration data signal terminal SDATA.

The duration data writing stage T11 and the light emitting adjustment stage T12 in the light emitting adjustment period T10 as well as the duration data writing stage T21 and the light emitting adjustment stage T22 in the light emitting adjustment period T20 in the circuit timing diagram shown in FIG. 7 are mainly selected. It should be explained that the signal of the first reference signal terminal V1 is a high-level signal, and the signal of the second reference signal terminal V2 is a low-level signal. Exemplarily, the voltage of the signal of the first reference signal terminal V1 is the same as the voltage of the high-level signal of the duration data signal terminal SDATA, and the voltage of the signal of the second reference signal terminal V2 is the same as the voltage of the low-level signal of the duration data signal terminal SDATA.

In the light emitting adjustment period T10, the operating process of the driving circuit in the duration data writing stage T11 may be substantially the same as the operating process of the driving circuit in the duration data writing stage T11 shown in FIG. 6A, and it is not described in detail herein.

The operating process of the driving circuit in the light emitting adjustment stage T12 may be substantially the same as the operating process of the driving circuit in the light emitting adjustment stage T12 shown in FIG. 6A, and it is not described in detail herein.

In the light emitting adjustment period T20, the operating process of the driving circuit in the duration data writing stage T21 may be substantially the same as the operating process of the driving circuit in the duration data writing stage T11 shown in FIG. 6B, and it is not described in detail herein.

The operating process of the driving circuit in the light emitting adjustment stage T22 may be substantially the same as the operating process of the driving circuit in the light emitting adjustment stage T12 shown in FIG. 6B, and it is not described in detail herein.

Of course, the sequence of the light emitting adjustment period T10 and the light emitting adjustment period T20 in one frame of display time F is not specifically limited, for example, in one frame of display time F, the light emitting adjustment period T10 may occur first, and then the light emitting adjustment period T20 may occur later. Alternatively, in one frame of display time F, the light emitting adjustment period T20 may occur first, and then the light emitting adjustment period T10 may occur later.

In summary, the first transistor M1 may be turned on in the same frame of display time, so that the light emitting device DL may emit light. The first transistor M1 may also be turned off so that the light emitting device DL does not emit light. Thus, the light emitting time of the light emitting device DL in one frame of display time may be controlled, and light emitting brightness is adjusted.

Further, in specific implementation, when the driving circuit includes a driving signal control circuit 30, in the embodiment of the present disclosure, in one frame of display time and before the light emitting adjustment period, a reset stage and a compensation stage may be further included.

In the reset stage, the driving signal control circuit 30 resets in response to a signal of the reset signal terminal RST.

In the compensation stage, the driving signal control circuit 30 carries out threshold compensation according to the signal of the display scanning signal terminal XGATE and the signal of the display data signal terminal XDATA.

In light emitting adjustment stage: in a preset duration, the driving signal control circuit 30 communicates the signal input terminal INP with the first transistor M1 in response to the signal of the light emitting control signal terminal EM; when the first transistor M1 is turned on, a driving signal for driving the light emitting device DL is generated to drive the light emitting device DL to emit light; and the preset duration is not greater than the duration of the light emitting adjustment stage.

In specific implementation, in the embodiment of the present disclosure, when the driving circuit is driven to operate in at least two light emitting adjustment periods in one frame of display time, the preset durations in the various light emitting adjustment periods may be the same, or the preset durations in part of the light emitting adjustment periods may be the same, and the preset durations in the remaining light emitting adjustment periods are different with one another.

Alternatively, the preset durations in the various light emitting adjustment periods are different with one another. For example, in every two adjacent light emitting adjustment periods, a preset duration in the previous light emitting adjustment period is greater than a preset duration in the next light emitting adjustment period. Alternatively, in every two adjacent light emitting adjustment periods, a preset duration in the previous light emitting adjustment period is smaller than a preset duration in the next light emitting adjustment period. Further, the value of difference between the preset durations in every two adjacent light emitting adjustment periods is the same. Alternatively, the ratio of the preset durations in every two adjacent light emitting adjustment periods is the same. It is not limited herein.

Figure 4:
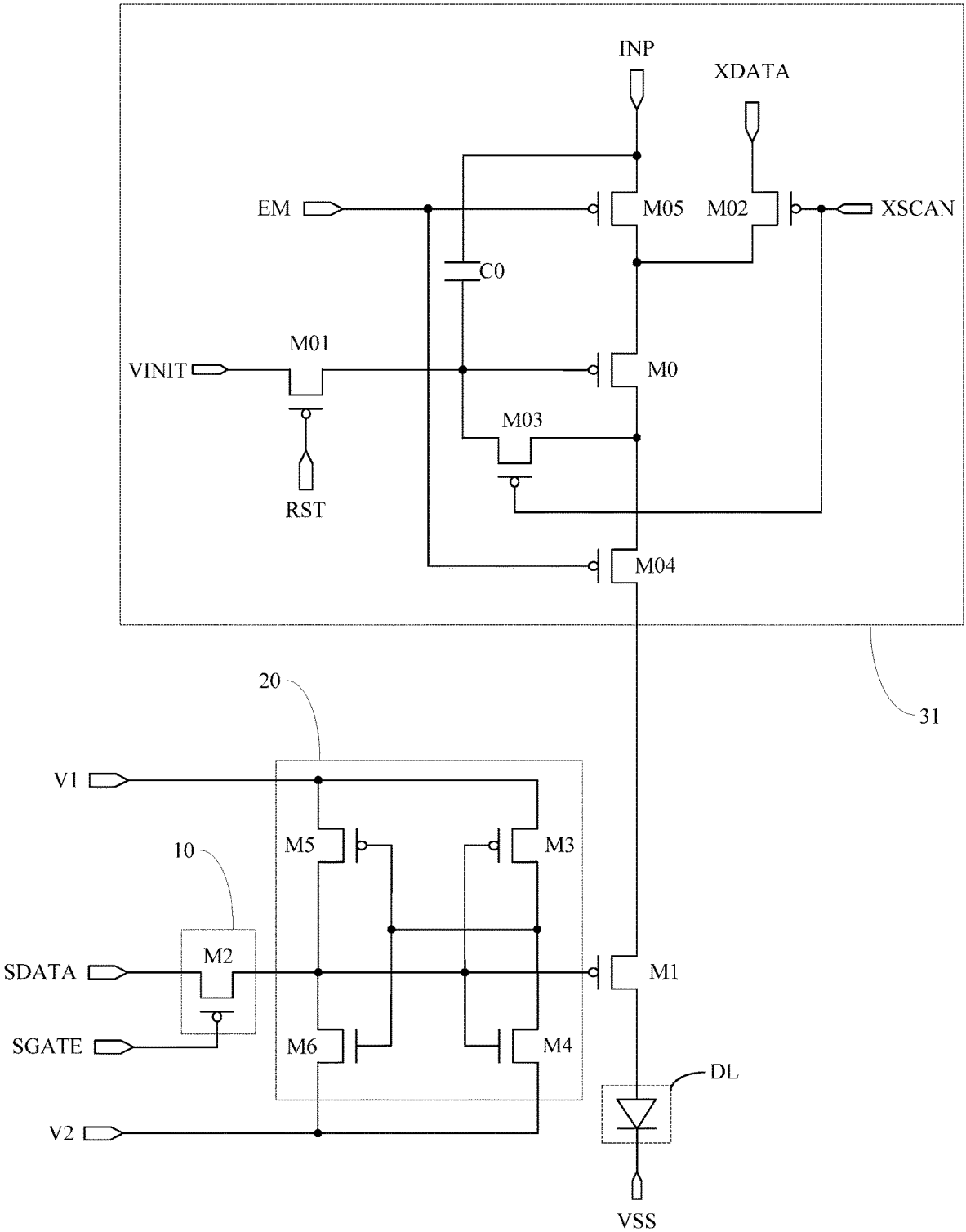
FIG. 4 is a schematic diagram of specific structures of some other driving circuits according to an embodiment of the present disclosure.
Figure 8:
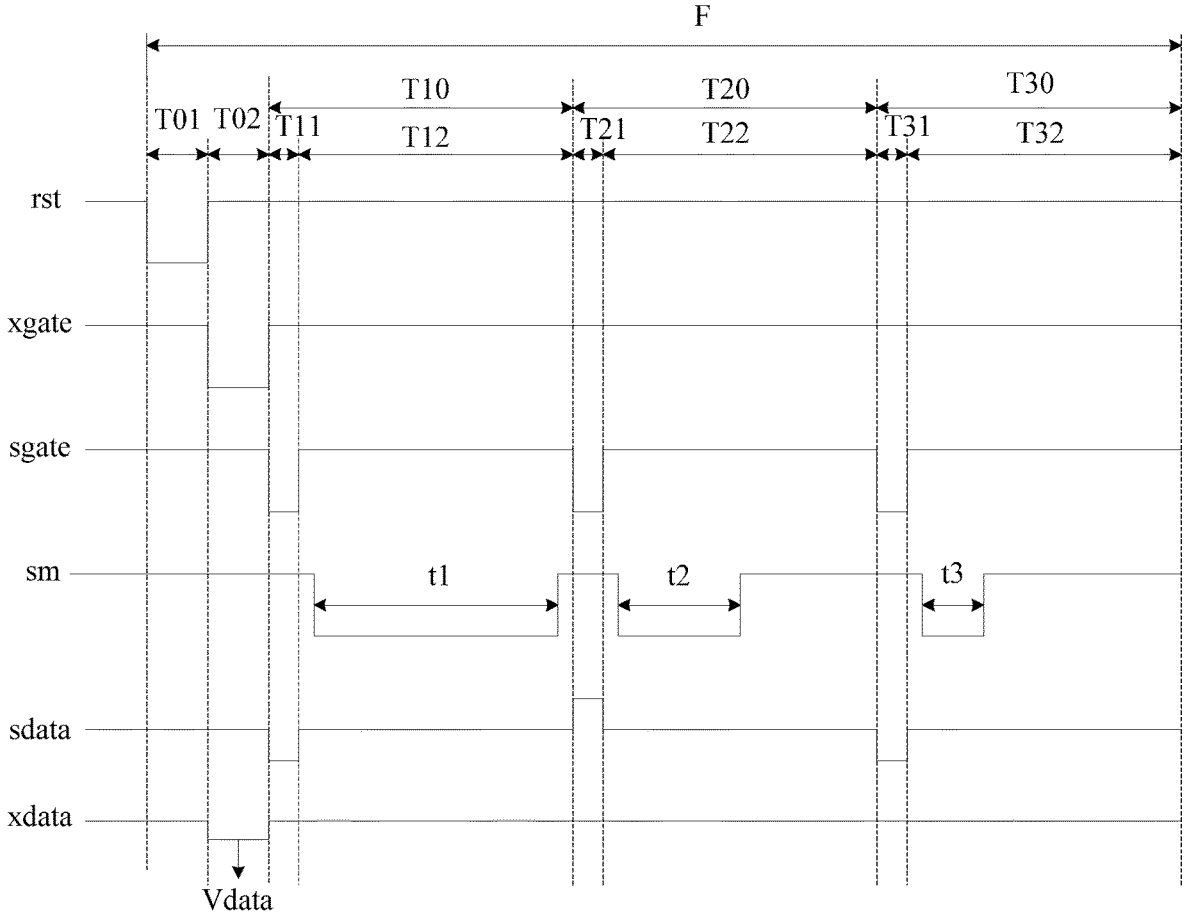
FIG. 8 is a timing diagram of some other circuits according to an embodiment of the present disclosure.

The operating process of the driving circuit provided by the embodiment of the present disclosure is described in combination with the circuit timing diagram shown in FIG. 8 by taking the structure of the driving circuit shown in FIG. 4 as an example. Wherein, rst represents the signal of the reset signal terminal RST, xgate represents the signal of the display scanning signal terminal XGATE, sgate represents the signal of the duration scanning signal terminal SGATE, sm represents the signal of the light emitting control signal terminal EM, sdata represents the signal of the duration data signal terminal SDATA, and xdata represents the signal of the display data signal terminal XDATA.

The reset stage T01, the compensation stage T02, the light emitting adjustment period T10, the light emitting adjustment period T20 and the light emitting adjustment period T30 in the circuit timing sequence diagram shown in FIG. 8 are mainly selected. The light emitting adjustment period T10 includes a duration data writing stage T11 and a light emitting adjustment stage T12. The light emitting adjustment period T20 includes a duration data writing stage T21 and a light emitting adjustment stage T22. The light emitting adjustment period T30 includes a duration data writing stage T31 and a light emitting adjustment stage T32. It should be explained that the signal of the first reference signal terminal V1 is a high-level signal, and the signal of the second reference signal terminal V2 is a low-level signal. Exemplarily, the voltage of the signal of the first reference signal terminal V1 is the same as the voltage of the high-level signal of the duration data signal terminal SDATA, and the voltage of the signal of the second reference signal terminal V2 is the same as the voltage of the low-level signal of the duration data signal terminal SDATA.

In the reset stage T01, the signal xgate of the display scanning signal terminal XGATE is a high-level signal, and the second switch transistor M02 and the third switch transistor M03 are turned off. A signal sm of the light emitting control signal terminal EM is a high-level signal, and the fourth switch transistor M04 and the fifth switch transistor M05 are turned off. The signal sgate of the duration scanning signal terminal SGATE is a high-level signal, and the second transistor M2 is turned off. The signal of the reset signal terminal RST is a low-level signal, and the first switch transistor M01 is turned on. The first switch transistor M01 which is turned on provides the signal of the initialization signal terminal VINIT to the gate of the driving transistor M0, so that the gate of the driving transistor M0 is the voltage Vinit of the signal of the initialization signal terminal VINIT, and the gate of the driving transistor M0 is reset.

In the compensation stage T02, the signal sm of the light emitting control signal terminal EM is a high-level signal, and the fourth switch transistor M04 and the fifth switch transistor M05 are turned off. The signal sgate of the duration scanning signal terminal SGATE is a high-level signal, and the second transistor M2 is turned off. The signal of the reset signal terminal RST is a high-level signal, and the first switch transistor M01 is turned off. The signal xgate of the display scanning signal terminal XGATE is a low-level signal, and the second switch transistor M02 and the third switch transistor M03 are turned on. By the third switch transistor M03 which is turned on, the gate of the driving transistor M0 communicates with the second terminal of the driving transistor M0, so that a diode connection mode is adopted for the driving transistor M0. The second switch transistor M02 which is turned on provides the signal xdata of the display data signal terminal XDATA to the first terminal of the driving transistor M0 and charges the gate of the driving transistor M0 until the gate of the driving transistor M0 is charged to Vdata+Vth, and then the driving transistor M0 is turned off. The voltage of the gate of the driving transistor M0 is stored by the storage capacitor C0. Vth is the threshold voltage of the driving transistor M0. In this way, the threshold voltage of the driving transistor M0 may be written into the gate of the driving transistor M0 so as to achieve compensation on the threshold voltage.

In the duration data writing stage T11 in the light emitting adjustment period T10, the signal sm of the light emitting control signal terminal EM is a high-level signal, and the fourth switch transistor M04 and the fifth switch transistor M05 are turned off. The signal of the reset signal terminal RST is a high-level signal, and the first switch transistor M01 is turned off. The signal xgate of the display scanning signal terminal XGATE is a high-level signal, and the second switch transistor M02 and the third switch transistor M03 are turned off. The signal sgate of the duration scanning signal terminal SGATE is a low-level signal, and the second transistor M2 is turned on, so that the low-level signal sdata of the duration data signal terminal SDATA is provided for the gate of the first transistor M1, the level of the gate of the first transistor M1 is low, the first transistor M1 and the third transistor M3 are turned on, and the fourth transistor M4 is turned off. By the first transistor M1 which is turned on, the fourth switch transistor M04 communicates with the light emitting device DL. The third transistor M3 which is turned on provides the high-level signal of the first reference signal terminal V1 to the gate of the fifth transistor M5 and the gate of the sixth transistor M6 so as to turn off the fifth transistor M5 and turn on the sixth transistor M6. The sixth transistor M6 which is turned on provides the low-level signal of the second reference signal terminal V2 to the gate of the first transistor M1, so that the level of the gate of the first transistor M1 is further low, and the level of the gate of the first transistor M1 is latched.

In the light emitting adjustment stage T12, the signal sgate of the duration scanning signal terminal SGATE is a high-level signal, and the second transistor M2 is turned off. The signal of the reset signal terminal RST is a high-level signal, and the first switch transistor M01 is turned off. The signal xgate of the display scanning signal terminal XGATE is a high-level signal, and the second switch transistor M02 and the third switch transistor M03 are turned off. Due to the effects of the third transistor M3, the fourth transistor M4, the fifth transistor M5 and the sixth transistor M6, the level of the gate of the first transistor M1 may be latched to a low level, so that the first transistor M1 is turned on. If the signal sm of the light emitting control signal terminal EM is a low-level signal within a preset duration t1, the fourth switch transistor M04 and the fifth switch transistor M05 are turned on. The fifth switch transistor M05 which is turned on provides the voltage Vdd of the signal input terminal INP to the first terminal of the driving transistor M0, so that the voltage of the first terminal of the driving transistor M0 is Vdd. Under the action of the storage capacitor C0, the voltage of the gate of the driving transistor M0 is kept at Vdata+Vth. Therefore, the driving transistor M0 generates a driving current IL: $IL=K[Vdata-Vdd]^2$; wherein K is a structural parameter, and in the same structure, K may be regarded as a constant. Because the first transistor M1 is turned on, the driving current IL is provided for the light emitting device DL in the preset duration t1, so that the light emitting device DL may emit light in the preset duration t1.

In the duration data writing stage T21 in a light emitting adjustment period T20, the signal sm of the light emitting control signal terminal EM is a high-level signal, and the fourth switch transistor M04 and the fifth switch transistor M05 are turned off. The signal of the reset signal terminal RST is a high-level signal, and the first switch transistor M01 is turned off. The signal xgate of the display scanning signal terminal XGATE is a high-level signal, and the second switch transistor M02 and the third switch transistor M03 are turned off. The signal sgate of the duration scanning signal terminal SGATE is a low-level signal, and the second transistor M2 is turned on, so that the high-level signal sdata of the duration data signal terminal SDATA is provided for the gate of the first transistor M1, the level of the gate of the first transistor M1 is high, the first transistor M1 and the third transistor M3 are turned off, and the fourth transistor M4 is turned on. The fourth transistor M4 which is turned on provides the low-level signal of the second reference signal terminal V2 to the gate of the fifth transistor M5 and the gate of the sixth transistor M6 so as to turn on the fifth transistor M5 and turn off the sixth transistor M6. The fifth transistor M5 which is turned on provides the high-level signal of the first reference signal terminal V1 to the gate of the first transistor M1, so that the level of the gate of the first transistor M1 is further high, and the level of the gate of the first transistor M1 is latched.

In the light emitting adjustment stage T22, the signal sgate of the duration scanning signal terminal SGATE is a high-level signal, and the second transistor M2 is turned off. The signal of the reset signal terminal RST is a high-level signal, and the first switch transistor M01 is turned off. The signal xgate of the display scanning signal terminal XGATE is a high-level signal, and the second switch transistor M02 and the third switch transistor M03 are turned off. Due to the effects of the third transistor M3, the fourth transistor M4, the fifth transistor M5 and the sixth transistor M6, the level of the gate of the first transistor M1 may be latched to a high level, so that the first transistor M1 is turned off, and the light emitting device DL may not emit light in a preset duration t2.

In the duration data writing stage T31 in the light emitting adjustment period T30, the signal sm of the light emitting control signal terminal EM is a high-level signal, and the fourth switch transistor M04 and the fifth switch transistor M05 are turned off. The signal of the reset signal terminal RST is a high-level signal, and the first switch transistor M01 is turned off. The signal xgate of the display scanning signal terminal XGATE is a high-level signal, and the second switch transistor M02 and the third switch transistor M03 are turned off. The signal sgate of the duration scanning signal terminal SGATE is a low-level signal, and the second transistor M2 is turned on, so that the low-level signal sdata of the duration data signal terminal SDATA is provided for the gate of the first transistor M1, the level of the gate of the first transistor M1 is low, the first transistor M1 and the third transistor M3 are turned on, and the fourth transistor M4 is turned off. By the first transistor M1 which is turned on, the fourth switch transistor M04 communicates with the light emitting device DL. The third transistor M3 which is turned on provides the high-level signal of the first reference signal terminal V1 to the gate of the fifth transistor M5 and the gate of the sixth transistor M6 so as to turn off the fifth transistor M5 and turn on the sixth transistor M6. The sixth transistor M6 which is turned on provides the low-level signal of the second reference signal terminal V2 to the gate of the first transistor M1, so that the level of the gate of the first transistor M1 is further low, and the level of the gate of the first transistor M1 is latched.

In the light emitting adjustment stage T32, the signal sgate of the duration scanning signal terminal SGATE is a high-level signal, and the second transistor M2 is turned off. The signal of the reset signal terminal RST is a high-level signal, and the first switch transistor M01 is turned off. The signal xgate of the display scanning signal terminal XGATE is a high-level signal, and the second switch transistor M02 and the third switch transistor M03 are turned off. Due to the effects of the third transistor M3, the fourth transistor M4, the fifth transistor M5 and the sixth transistor M6, the level of the gate of the first transistor M1 may be latched to a low level, so that the first transistor M1 is turned on. If the signal sm of the light emitting control signal terminal EM is a low-level signal within a preset duration t3, the fourth switch transistor M04 and the fifth switch transistor M05 are turned on. The fifth switch transistor M05 which is turned on provides the voltage Vdd of the signal input terminal INP to the first terminal of the driving transistor M0, so that the voltage of the first terminal of the driving transistor M0 is Vdd. Under the action of the storage capacitor C0, the voltage of the gate of the driving transistor M0 is kept at Vdata+Vth. Therefore, the driving transistor M0 generates a driving current IL: $IL=K[Vdata-Vdd]^2$; wherein K is a structural parameter, and in the same structure, K may be regarded as a constant. Since the first transistor M1 is turned on, the driving current IL is provided for the light emitting device DL in the preset duration t3, and the light emitting device DL may emit light in the preset duration t3.

Therefore, the brightness duration of the light emitting device may be controlled by controlling the turned-on duration of the first transistor in one frame of time, and a multi-gray-scale display effect may be achieved.

Moreover, for example, t1:t2:t3=4:2:1. Of course, in actual application, t1:t2:t3 may also be designed and determined in accordance with an actual application environment, and it is not limited herein.

Figure 9:
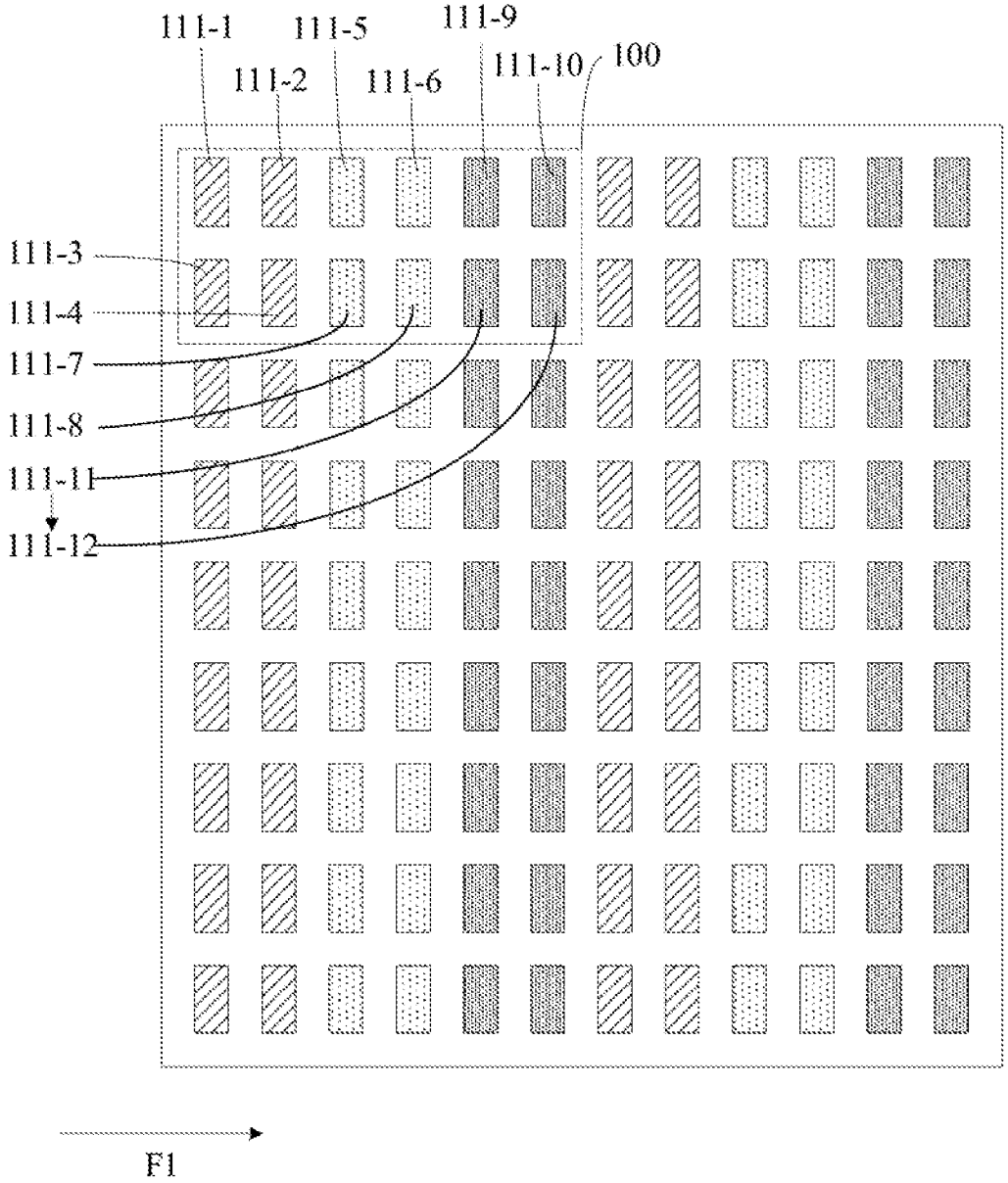
FIG. 9 is a schematic top view of structures of some display panels according to an embodiment of the present disclosure.

Based on the same inventive concept, the embodiment of the present disclosure also provides a display panel, as shown in FIG. 9, the display panel includes a plurality of pixel elements 100, at least one of the plurality of pixel elements 100 includes a plurality of sub-pixels 111-k ($1 \le k \le K$, k and K are both integers, and K is the total number of the sub-pixels in one pixel element); each of the plurality of sub-pixels 111-k includes one light emitting device DL and one driving circuit; and the driving circuit is the driving circuit provided by the embodiment of the present disclosure. Moreover, the structure of the driving circuit may be referred to the foregoing structure, and it is not described in detail herein.

In specific implementation, in an embodiment of the present disclosure, K may equal to 2, and then the pixel element may include 2 sub-pixels. K may equal to 3, and then the pixel element may include 3 sub-pixels. K may equal to 6, and then the pixel element may include 6 sub-pixels. K may equal to 9, and then the pixel element may include 9 sub-pixels. K may also equal to 12, and as shown in FIG. 9, the pixel element may include 12 sub-pixels. Of course, the value of K may be designed and determined according to an actual application environment, and it is not limited herein.

In specific implementation, in an embodiment of the present disclosure, as shown in FIG. 9, each of the plurality of pixel elements includes a plurality of sub-pixels 111-k arranged in an array. The plurality of sub-pixels include sub-pixels in at least two colors, and the number of the sub-pixels in each color is at least two. For example, the pixel element may include sub-pixels in two colors, the number of the sub-pixels in each color is at least two, or the pixel element may include sub-pixels in three colors, and the number of the sub-pixels in each color is at least two, or the pixel element may also include sub-pixels in four colors, the number of the sub-pixels in each color is at least two, it may be designed and determined according to an actual application environment, and it is not limited herein.

In specific implementation, in an embodiment of the present disclosure, as shown in FIG. 9, each of the pixel elements may include sub-pixels in three colors, for example, the number of the sub-pixels in each color is four, sub-pixels in a first color 111-1~111-4, sub-pixels in a second color 111-5~111-8, and sub-pixels in a third color 111-9~111-12. Exemplarily, the first color, the second color and the third color may be selected from red, green and blue to display an image by color mixing of red, green and blue. For example, the first color may be red, the second color may be green, and the third color may be blue.

Moreover, the pixel element includes sub-pixels in at least two colors, the number of the sub-pixels in each color is at least two, each sub-pixel is provided with one light emitting device DL and one driving circuit, so that each sub-pixel may emit light independently, one same-color with multi-gray-scale is realized, for example, when the pixel element includes red, green and blue sub-pixels and the number of the sub-pixels in each color is four. The red sub-pixels are taken as an example. If the first transistor is off within one frame of display time, all the red sub-pixels do not emit light, and the red sub-pixels serve as zero gray scale. If only the first transistor in one red sub-pixel is on in one frame of display time, then the red sub-pixel emits light and serves as ¼ gray scale. If only the first transistors in two red sub-pixels are on, then the two red sub-pixels emit light and serve as ⅔ gray scale. If only the first transistors in three red sub-pixels are on, then the three red sub-pixels emit light and serve as ¾ gray scale. If only the first transistors in four red sub-pixels are on, then the four red sub-pixels emit light and serve as the brightest gray scale. That is, in one pixel element, the red portion may be in 5 gray scales from a dark state to a bright state. In a similar way, in one pixel element, a green portion may be in 5 gray scales from a dark state to a bright state, and the blue portion may also be in 5 gray scales from a dark state to a bright state. Therefore, one pixel element may display 125 gray scales of colors.

Alternatively, if the first transistor in one sub-pixel is on in part of the preset duration, and is off in the remaining preset duration, then gray scales which may be realized by the sub-pixels may be further increased, thus, the gray scales of the pixel element may be further increased, and the pixel element may be in more colors.

The red sub-pixels are taken as an example. In one frame of display time: if the first transistors are off, then the red sub-pixels do not emit light and have the zero gray scale.

In one frame of display time: if the first transistor in one red sub-pixel is only on in the preset duration t3 and is off in the preset duration t2 and the preset duration t1, then the red sub-pixel emits light and may have have 1/7 gray scale.

In one frame of display time: if the first transistor in one red sub-pixel is only on in the preset duration t2, and is off in the preset duration t1 and the preset duration t3, then the red sub-pixel emits light and may have 2/7 gray scale.

In one frame of display time: if the first transistor in one red sub-pixel is only on in the preset duration t2 and the preset duration t3, and is off in the preset duration t1, then the red sub-pixel emits light and may have 3/7 gray scale.

In one frame of display time: if the first transistor in one red sub-pixel is only on in the preset duration t1, and is off in the preset duration t2 and the preset duration t3, then the red sub-pixel emits light and may have 4/7 gray scale.

In one frame of display time: if the first transistor in one red sub-pixel is only on in the preset duration t1 and the preset duration t3, and is off in the preset duration t2, then the red sub-pixel emits light and may have 5/7 gray scale.

In one frame of display time: if the first transistor in one red sub-pixel is only on in the preset duration t1 and the preset duration t2, and is off in the preset duration t3, then the red sub-pixel emits light and may have 6/7 gray scale.

In one frame of display time: if the first transistor in one red sub-pixel is on in the preset duration t1, the preset duration t2 and the preset duration t3, then the red sub-pixel emits light and may have the brightest gray scale.

That is, in one pixel element, one red sub-pixel may have 8 gray scales from the dark state to the brightest state. If one pixel element has four red sub-pixels, then the red gray scales in the pixel element may have $8^4$ gray scales. Further, if one pixel element has red, green and blue sub-pixels and the number of the sub-pixels in each color is four, then the pixel element may have $8^{12}$ gray scales.

In specific implementation, in an embodiment of the present disclosure, as shown in FIG. 9, the sub-pixels in the same color are adjacent, and the sub-pixels in the first color, the sub-pixels in the second color and the sub-pixels in the third color are sequentially arranged in the first direction (the direction of an F1 arrow). For example, the sub-pixels 111-1~111-4 in the first color are adjacent to form a 2*2 matrix arrangement mode. The sub-pixels 111-5~111-8 in the second color are adjacent to form a 2*2 matrix arrangement mode. The sub-pixels 111-9~111-12 in the third color are adjacent to form a 2*2 matrix arrangement mode.

Figure 10:
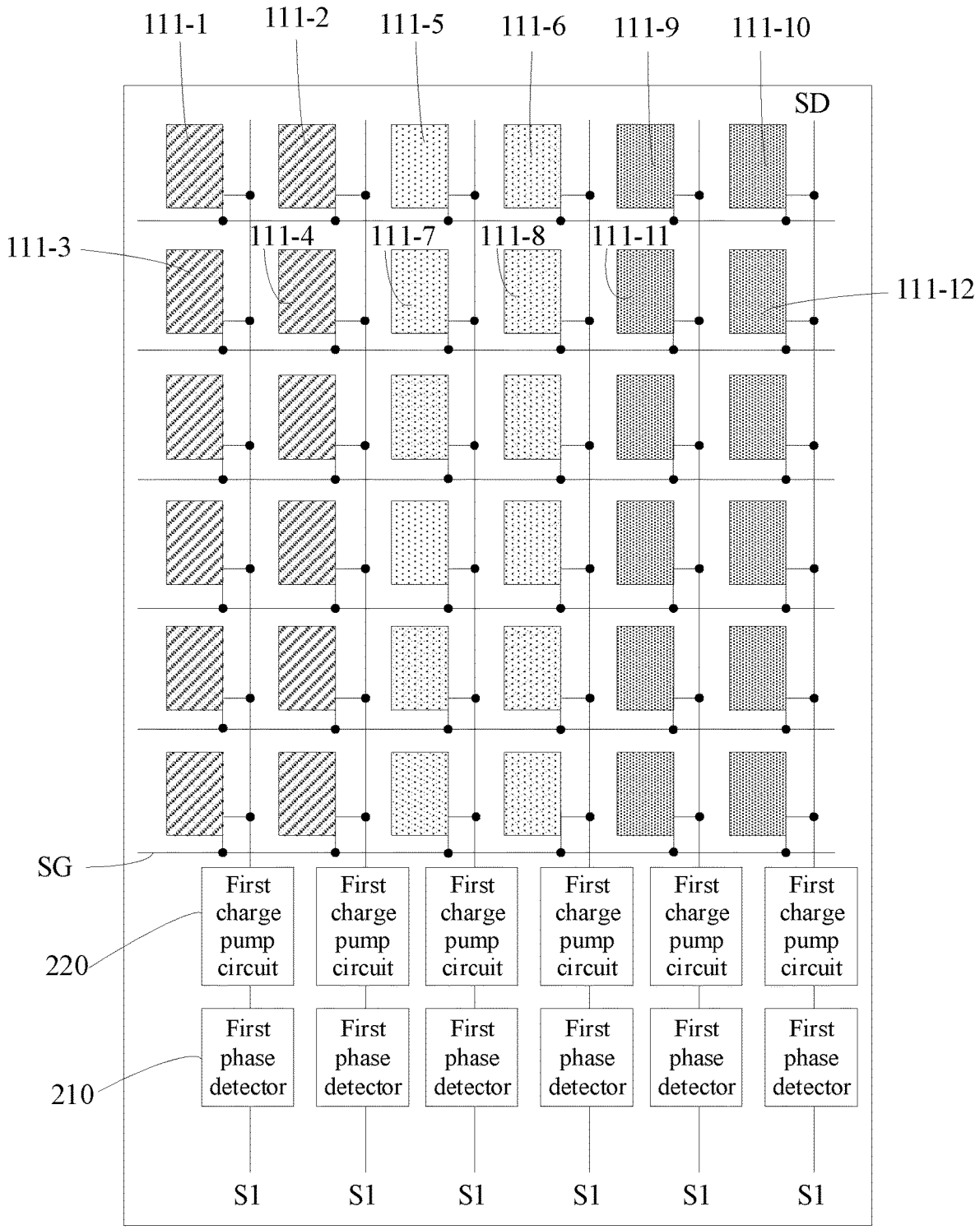
FIG. 10 is a schematic top view of structures of some other display panels according to an embodiment of the present disclosure.

In specific implementation, an embodiment of the present disclosure, in combination with FIG. 2, FIG. 4 and FIG. 10, the display panel may further include a plurality of duration data lines SD; and the duration data signal terminals SDATA of the driving circuits of the sub-pixels in the same column are electrically connected with the same duration data line SD. Therefore, signals may be provided for the driving circuits through the duration data line SD.

In specific implementation, in the embodiment of the present disclosure, in combination with FIG. 2, FIG. 4 and FIG. 10, the display panel may further include a plurality of duration scanning lines SG; and the duration scanning signal terminals XGATE of the driving circuits of the sub-pixels in the same row are electrically connected with one duration scanning line SG. Therefore, signals may be provided for the driving circuits through the duration scanning lines.

Generally, along with increasing of refresh frequency of the display panel, charging time is shortened correspondingly, and power consumption of a driving chip is increased correspondingly. In order to enable the display panel to have higher refresh frequency, in specific implementation, in an embodiment of the present disclosure, as shown in FIG. 10, the display panel may further include a plurality of first duration data input lines S1, a plurality of first phase detectors 210 and a plurality of first charge pump circuits 220; and one duration data line SD corresponds to one first phase detector 210, one first charge pump circuit 220 and one first duration data input line S1. Each first duration data input line S1 is electrically connected with the corresponding duration data line SD through the corresponding first phase detector 210 and the corresponding first charge pump circuit 220 successively. Thus, a low-voltage signal may be loaded for each first duration data input line S1, then the signal loaded by each first duration data input line S1 may be detected through the corresponding first phase detector 210, then the detected signal is inputted to the corresponding first charge pump circuit 220, and after the first charge pump circuit 220 boosts the voltage of the received signal, the signal is provided for the duration data line SD. Thus, when the second transistor M2 is turned on, the signal on the duration data line SD may be provided for the gate of the first transistor M1 to charge the gate of the first transistor M1 through low voltage. Therefore, the power consumption of the driving chip may be reduced.

Figure 11:
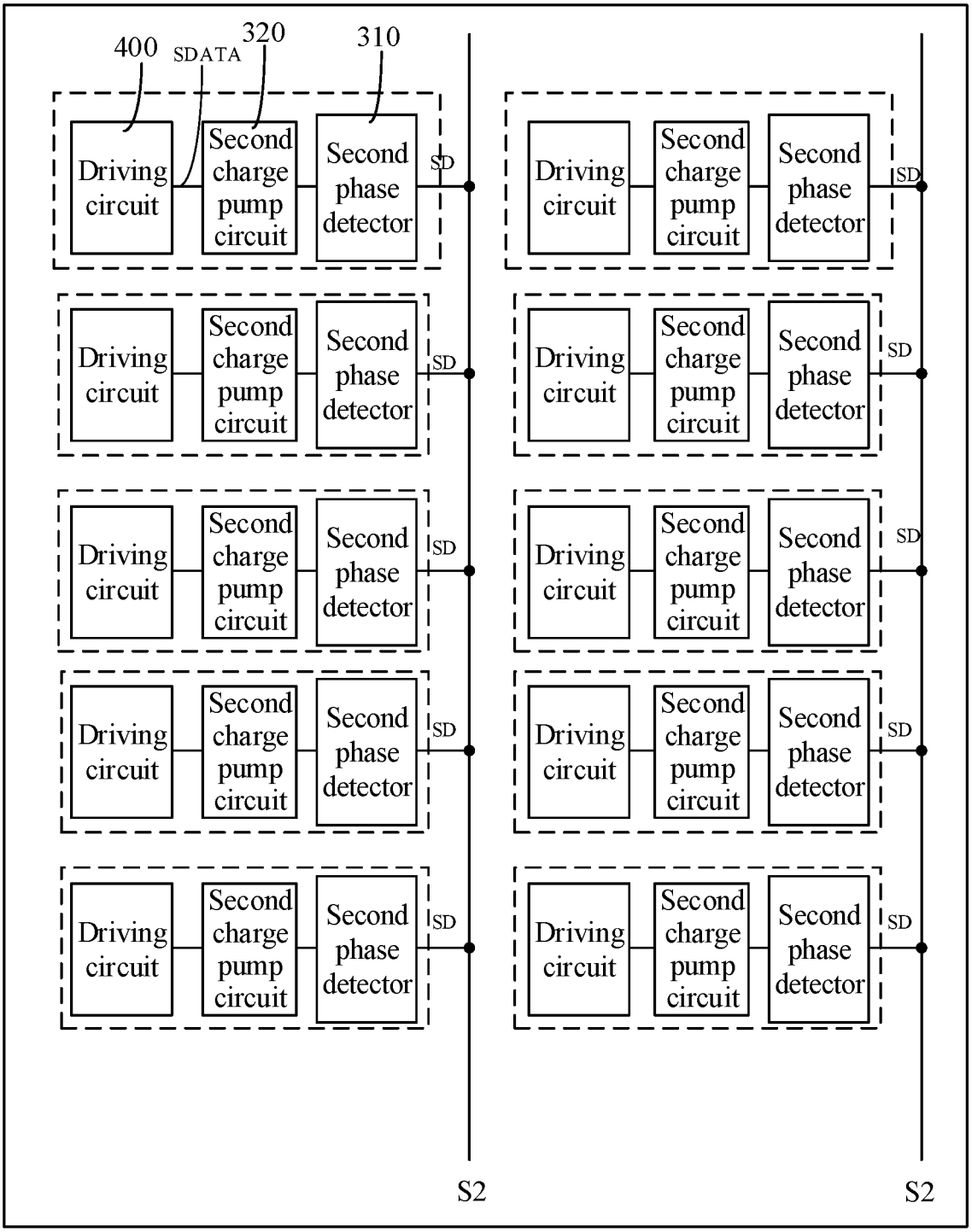
FIG. 11 is a schematic top view of structures of some other display panels according to an embodiment of the present disclosure.

In specific implementation, in an embodiment of the present disclosure, as shown in FIG. 11, the display panel may further include a plurality of second duration data input lines S2, a plurality of second phase detectors 310 and a plurality of second charge pump circuits 320; wherein one second duration data input line S2 is electrically connected with one duration data line SD; one sub-pixel includes one second phase detector 310 and one second charge pump circuit 320; and for each of the sub-pixels, the duration data line SD is electrically connected with the duration data signal terminal SDATA of the driving circuit 400 through the corresponding second phase detector 310 and the corresponding second charge pump circuit 320 successively. Thus, a low-voltage signal may be loaded for the second duration data input lines S2 to charge the duration data lines SD. The second phase detector 310 in each sub-pixel detects the signal transmitted by the duration data line SD which is electrically connected with the second phase detector 310, after that, the detected signal is input to the corresponding second charge pump circuit 320, and after the second charge pump circuit 320 boosts the voltage of the received signal, the received signal is provided for the first terminal of the second transistor M2. When the second transistor M2 is turned on, the signal of the first terminal of the second transistor M2 may be provided for the gate of the first transistor M1 to charge the gate of the first transistor M1 by low voltage. Therefore, the power consumption of the driving chip may be reduced.

Figure 12:
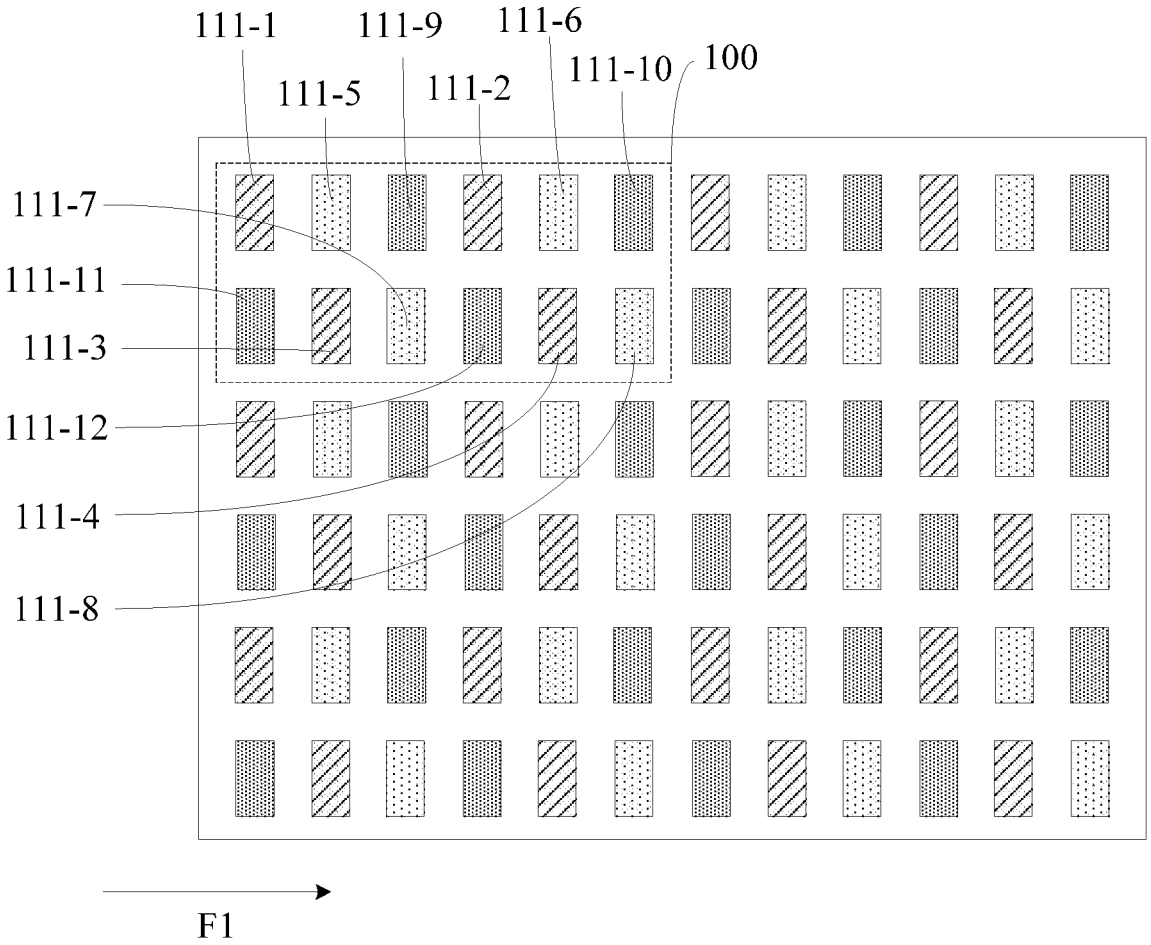
FIG. 12 is a schematic top view of structures of some other display panels according to an embodiment of the present disclosure.

An embodiment of the present disclosure further provides another display panel, as shown in FIG. 12. The display panel is modified with respect to the implementation modes in the foregoing embodiments. Only the differences between the present embodiment and the foregoing embodiments will be described below, and the same parts will not be described herein again.

In specific implementation, in the embodiment of the present disclosure, as shown in FIG. 12, sub-pixels in other colors are arranged among sub-pixels in the same color in the first direction F1 (the direction of an F1 arrow). For example, the sub-pixel in the second color 111-5 and the sub-pixel in the third color 111-9 are arranged between the sub-pixel in the first color 111-1 and the sub-pixel in the first color 111-2. The sub-pixel in the third color 111-9 and the sub-pixel in the first color 111-2 are arranged between the sub-pixel in the second color 111-5 and the sub-pixel in the second color 111-6. The sub-pixel in the first color 111-2 and the sub-pixel in the second color 111-6 are arranged between the sub-pixel in the third color 111-9 and the sub-pixel in the third color 111-10. The sub-pixel in the first color 111-3 and the sub-pixel in the second color 111-7 are arranged between the sub-pixel in the third color 111-11 and the sub-pixel in the third color 111-12. The sub-pixel in the second color 111-7 and the sub-pixel in the third color 111-12 are arranged between the sub-pixel in the first color 111-3 and the sub-pixel in the first color 111-4. The sub-pixel in the third color 111-12 and the sub-pixel in the first color 111-4 are arranged between the sub-pixel in the second color 111-7 and the sub-pixel in the second color 111-8. Because a plurality of sub-pixels have the same color in the same pixel element, if the sub-pixels in the same color are arranged together, graininess in a display screen in vision is easily caused. In an embodiment of the present disclosure, sub-pixels in other colors are arranged among the sub-pixels in the same color, the sub-pixels in the same color may be segmented to relieve the graininess in the display screen in vision.

In specific implementation, in an embodiment of the present disclosure, as shown in FIG. 12, in the same pixel element 100, the sub-pixels in the first color 111-1~111-4, the sub-pixels in the second color 111-5~111-8, the sub-pixel in the third color 111-9~111-12 are arranged into a two-row six-column structure. In the first row of the two-row six-column structure, the sub-pixel in the first color, the sub-pixel in the second color and the sub-pixel in the third color are successively arranged; and for example, the sub-pixel in the first color 111-1, the sub-pixel in the second color 111-5, the sub-pixel in the third color 111-9, the sub-pixel in the first color 111-2, the sub-pixel in the second color 111-6 and the sub-pixel in the third color 111-10 are successively arranged.

Moreover, in the second line of the two-row six-column structure, the sub-pixel in the third color, the sub-pixel in the first color and the sub-pixel in the second color are successively arranged. For example, the sub-pixel in the third color 111-11, the sub-pixel in the first color 111-3, the sub-pixel in the second color 111-7, the sub-pixel in the third color 111-12, the sub-pixel in the first color 111-4 and the sub-pixel in the second color 111-8 are successively arranged.

Of course, in the same pixel element, the arrangement of the sub-pixels in various colors may adopt another mode, and it is not limited herein.

Based on the same inventive concept, an embodiment of the present disclosure further provides a display device including the display panel provided by the embodiment of the present disclosure. The principle for solving problems of the display device is similar to the principle for solving problems of the display panel, therefore, implementation of the display device may refer to implementation of the display panel, and the repetition of the description is not repeated herein.

In specific implementation, in an embodiment of the present disclosure, the display device may be any product or component with a display function, such as a mobile phone, a tablet computer, a television, a display, a notebook computer, a digital photo frame and a navigator. Other essential components of the display device are understood by those skilled in the art, and are not described herein nor should they be construed as limiting the present disclosure.

According to the driving circuit, the driving method thereof, the display panel and the display device which are provided by the embodiments of the present disclosure, by arrangement of the duration control circuit, the signal of the duration data signal terminal is provided to the gate of the first transistor under the control of the signal of the duration scanning signal terminal to control the turned-on duration of the first transistor so as to control the light emitting duration of the light emitting device to be driven. Moreover, the turned-on duration of the first transistor may further be controlled independently, so that the light emitting duration of the driving signal of the light emitting device to be driven may be adjusted independently. By arrangement of the latch circuit, the signal of the gate of the first transistor may be latched. Because the signal of the gate of the first transistor may be latched through the latch circuit, stability of the signal of the gate of the first transistor may be maintained for a long time, the driving circuit provided by the embodiment of the present disclosure may be applied to the display panel with low-frequency refresh to guarantee the display effect of the display panel. Moreover, compared with a capacitor, the latch circuit has the characteristic that the charging time of the signal may be shortened, and therefore, the driving circuit provided by the embodiment of the present disclosure may further be applied to the display panel with high-frequency refresh to guarantee the display effect of the display panel.

It will be apparent to those skilled in the art that various changes and modifications may be made in the embodiments of the present disclosure without departing from the spirit and scope of the embodiments of the present disclosure. Thus, if such modifications and variations of the embodiments of the present disclosure are within the scope of the claims of the present disclosure and their equivalents, the present disclosure is also intended to encompass such modifications and variations.

What is claimed is:

1. A driving circuit, configured to be driven to operate in at least one light emitting adjustment period in one frame of display time, and each of the at least one light emitting adjustment period comprises a duration data writing stage and a light emitting adjustment stage, wherein the driving circuit comprises:

a first transistor, electrically connected between a signal input terminal and a light emitting device to be driven;

a duration control circuit, configured to, in the duration data writing stage, provide a signal of a duration data signal terminal to a gate of the first transistor to turn on or off the first transistor in response to a signal of a duration scanning signal terminal;

a latch circuit, electrically connected with the gate of the first transistor, and configured to in the light emitting adjustment stage latch a signal of the gate of the first transistor so that the first transistor maintains a state of the duration data writing stage; and a driving signal control circuit, comprising a reset signal terminal, a display scanning signal terminal, a light emitting control signal terminal and a display data signal terminal;

wherein the signal input terminal is electrically connected with the first transistor through the driving signal control circuit;

wherein a reset stage and a compensation stage, before the light emitting adjustment period, are comprised in the one frame of display time;

in the reset stage, the driving signal control circuit is configured to reset in response to a signal of the reset signal terminal;

in the compensation stage, the driving signal control circuit is configured to carry out threshold compensation according to a signal of the display scanning signal terminal and a signal of the display data signal terminal; and in the light emitting adjustment stage: in a preset duration, the driving signal control circuit is configured to communicates the signal input terminal with the first transistor in response to a signal of the light emitting control signal terminal, and generate a driving signal for driving the light emitting device to drive the light emitting device to emit light when the first transistor is turned on; wherein the preset duration is not greater than a duration of the light emitting adjustment stage.

2. The driving circuit according to claim 1, wherein the duration control circuit comprises a second transistor; and a gate of the second transistor is electrically connected with the duration scanning signal terminal, a first terminal of the second transistor is electrically connected with the duration data signal terminal, and a second terminal of the second transistor is electrically connected with the gate of the first transistor.

3. The driving circuit according to claim 2, wherein the latch circuit comprises a third transistor, a fourth transistor, a fifth transistor and a sixth transistor;

a gate of the third transistor is electrically connected with the gate of the first transistor, a first terminal of the third transistor is electrically connected with a first reference signal terminal, and a second terminal of the third transistor is electrically connected with a gate of the fifth transistor and a gate of the sixth transistor;

a gate of the fourth transistor is electrically connected with the gate of the first transistor, a first terminal of the fourth transistor is electrically connected with a second reference signal terminal, and a second terminal of the fourth transistor is electrically connected with the gate of the fifth transistor and the gate of the sixth transistor;

a first terminal of the fifth transistor is electrically connected with the first reference signal terminal, and a second terminal of the fifth transistor is electrically connected with the gate of the first transistor; and a first terminal of the sixth transistor is electrically connected with the second reference signal terminal, and a second terminal of the sixth transistor is electrically connected with the gate of the first transistor.

4. The driving circuit according to claim 1, wherein the latch circuit comprises a third transistor, a fourth transistor, a fifth transistor and a sixth transistor;

a gate of the third transistor is electrically connected with the gate of the first transistor, a first terminal of the third transistor is electrically connected with a first reference signal terminal, and a second terminal of the third transistor is electrically connected with a gate of the fifth transistor and a gate of the sixth transistor;

a gate of the fourth transistor is electrically connected with the gate of the first transistor, a first terminal of the fourth transistor is electrically connected with a second reference signal terminal, and a second terminal of the fourth transistor is electrically connected with the gate of the fifth transistor and the gate of the sixth transistor;

a first terminal of the fifth transistor is electrically connected with the first reference signal terminal, and a second terminal of the fifth transistor is electrically connected with the gate of the first transistor; and a first terminal of the sixth transistor is electrically connected with the second reference signal terminal, and a second terminal of the sixth transistor is electrically connected with the gate of the first transistor.

5. A display panel, comprising:

a plurality of pixel elements; wherein at least one of the plurality of pixel elements comprises a plurality of sub-pixels, each of the plurality of sub-pixels comprises one light emitting device and one driving circuit; wherein the driving circuit is the driving circuit according to claim 1.

6. The display panel according to claim 5, wherein each of the plurality of pixel elements comprises a plurality of sub-pixels arranged in an array, the plurality of sub-pixels comprise sub-pixels in at least two colors, and the number of the sub-pixels in each color is at least two.

7. The display panel according to claim 6, wherein each of the pixel elements comprises sub-pixels in a first color, sub-pixels in a second color and sub-pixels in a third color; and the sub-pixels in a same color are adjacent, and the sub-pixels in the first color, the sub-pixels in the second color and the sub-pixels in the third color are successively arranged in a first direction.

8. The display panel according to claim 7, wherein the display panel further comprises a plurality of duration data lines; and duration data signal terminals of driving circuits of the sub-pixels in a same column are electrically connected with a same duration data line.

9. The display panel according to claim 6, wherein each of the pixel elements comprises sub-pixels in a first color, sub-pixels in a second color and sub-pixels in a third color; and sub-pixels in other colors are arranged among the sub-pixels in a same color in the first direction.

10. The display panel according to claim 9, wherein a number of the sub-pixels in each color is four; in the pixel element, the sub-pixels in the first color, the sub-pixels in the second color and the sub-pixels in the third color are arranged into a two-row six-column structure;

in a first row of the two-row six-column structure, each of the sub-pixels in the first color, each of the sub-pixels in the second color and each of the sub-pixels in the third color are successively arranged; and in a second row of the two-row six-column structure, each of the sub-pixels in the third color, each of the sub-pixels in the first color and each of the sub-pixels in the second color are successively arranged.

11. The display panel according to claim 9, wherein the display panel further comprises a plurality of duration data lines; and duration data signal terminals of driving circuits of the sub-pixels in a same column are electrically connected with a same duration data line.

12. The display panel according to claim 6, wherein the display panel further comprises a plurality of duration data lines; and duration data signal terminals of driving circuits of the sub-pixels in a same column are electrically connected with a same duration data line.

13. The display panel according to claim 12, wherein the display panel further comprises a plurality of first duration data input lines, a plurality of first phase detectors and a plurality of first charge pump circuits; one duration data line corresponds to one first phase detector, one first charge pump circuit and one first duration data input line; and the respective one first duration data input line is electrically connected with the respective one duration data line through the corresponding first phase detector and the corresponding first charge pump circuit successively.

14. The display panel according to claim 12, wherein the display panel further comprises a plurality of second duration data input lines, a plurality of second phase detectors and a plurality of second charge pump circuits; one second duration data input line is electrically connected with one duration data line;

for each of the sub-pixels, one sub-pixel comprises one second phase detector and one second charge pump circuit; and for each of the sub-pixels, the duration data line is electrically connected with the duration data signal terminal of the driving circuit through the corresponding second phase detector and the corresponding second charge pump circuit successively.

15. A display device, comprising the display panel according to claim 5.

16. A driving method of the driving circuit according to claim 1, comprising:

driving the driving circuit to operate in at least one light emitting adjustment period in one frame of display time; wherein in the duration data writing stage, the duration control circuit provides a signal of a duration data signal terminal to the gate of the first transistor to turn on or off the first transistor in response to a signal of a duration scanning signal terminal; the latch circuit latches a signal of the gate of the first transistor; and in the light emitting adjustment stage, the latch circuit latches the signal of the gate of the first transistor so that the first transistor maintains the state of the duration data writing stage;

in the reset stage, the driving signal control circuit resets in response to a signal of the reset signal terminal;

in the compensation stage, the driving signal control circuit carries out threshold compensation according to a signal of the display scanning signal terminal and a signal of the display data signal terminal; and in the light emitting adjustment stage, the method further comprises: in a preset duration, the driving signal control circuit communicates the signal input terminal with the first transistor in response to a signal of the light emitting control signal terminal; and when the first transistor is turned on, a driving signal for driving the light emitting device is generated to drive the light emitting device to emit light; wherein the preset duration is not greater than a duration of the light emitting adjustment stage.

* * * * *